US011767748B2

(12) United States Patent
Payne et al.

(10) Patent No.: US 11,767,748 B2
(45) Date of Patent: Sep. 26, 2023

(54) WELL FRACTURING SYSTEMS WITH ELECTRICAL MOTORS AND METHODS OF USE

(71) Applicant: STEWART & STEVENSON, LLC, Houston, TX (US)

(72) Inventors: Mark Payne, Houston, TX (US); Haomin Lin, Houston, TX (US); Tom Robertson, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 0 days.

(21) Appl. No.: 17/860,786

(22) Filed: Jul. 8, 2022

(65) Prior Publication Data

US 2022/0349295 A1 Nov. 3, 2022

Related U.S. Application Data

(62) Division of application No. 16/940,257, filed on Jul. 27, 2020, now Pat. No. 11,408,267, which is a division of application No. 16/372,153, filed on Apr. 1, 2019, now Pat. No. 10,851,638, which is a division of application No. 15/060,296, filed on Mar. 3, 2016, now Pat. No. 10,246,984.

(60) Provisional application No. 62/128,291, filed on Mar. 4, 2015.

(51) Int. Cl.

| | |
|---|---|
| ***E21B 43/26*** | (2006.01) |
| ***E21B 44/00*** | (2006.01) |
| ***E21B 21/06*** | (2006.01) |

(52) U.S. Cl.
CPC ..... *E21B 44/00* (2013.01); *E21B 21/062* (2013.01); *E21B 43/26* (2013.01); *E21B 43/2607* (2020.05)

(58) Field of Classification Search
CPC ..... E21B 43/26; E21B 43/267; E21B 44/00; F04B 17/03
See application file for complete search history.

(56) References Cited

U.S. PATENT DOCUMENTS

| | | | | |
|---|---|---|---|---|
| 2,827,121 | A * | 3/1958 | Nowak | C09K 8/5086 166/295 |
| 5,425,421 | A * | 6/1995 | Coleman | E21B 33/138 166/250.14 |
| 8,789,601 | B2 | 7/2014 | Broussard et al. | |
| 9,410,410 | B2 | 8/2016 | Broussard et al. | |
| 9,650,879 | B2 | 5/2017 | Broussard et al. | |
| 2008/0209997 | A1 * | 9/2008 | Bailey | E21B 43/26 702/11 |
| 2016/0032703 | A1 * | 2/2016 | Broussard | E21B 43/2607 166/250.01 |

* cited by examiner

*Primary Examiner* — Kipp C Wallace
(74) *Attorney, Agent, or Firm* — Ewing & Jones, PLLC

(57) ABSTRACT

A system for stimulating oil or gas production from a wellbore includes a hydraulic fracturing pump unit having one or more hydraulic fracturing pumps driven by one or more electrical fracturing motors, a variable frequency drive (VFD) controlling the electrical fracturing motors, a fracturing pump blower unit driven by a blower motor, and a fracturing pump lubrication unit having a lubrication pump driven by a lubrication motor and a cooling fan driven by a cooling motor. The system may further include a blender unit and a hydration unit. A system control unit may control the operational parameters of the system.

9 Claims, 19 Drawing Sheets

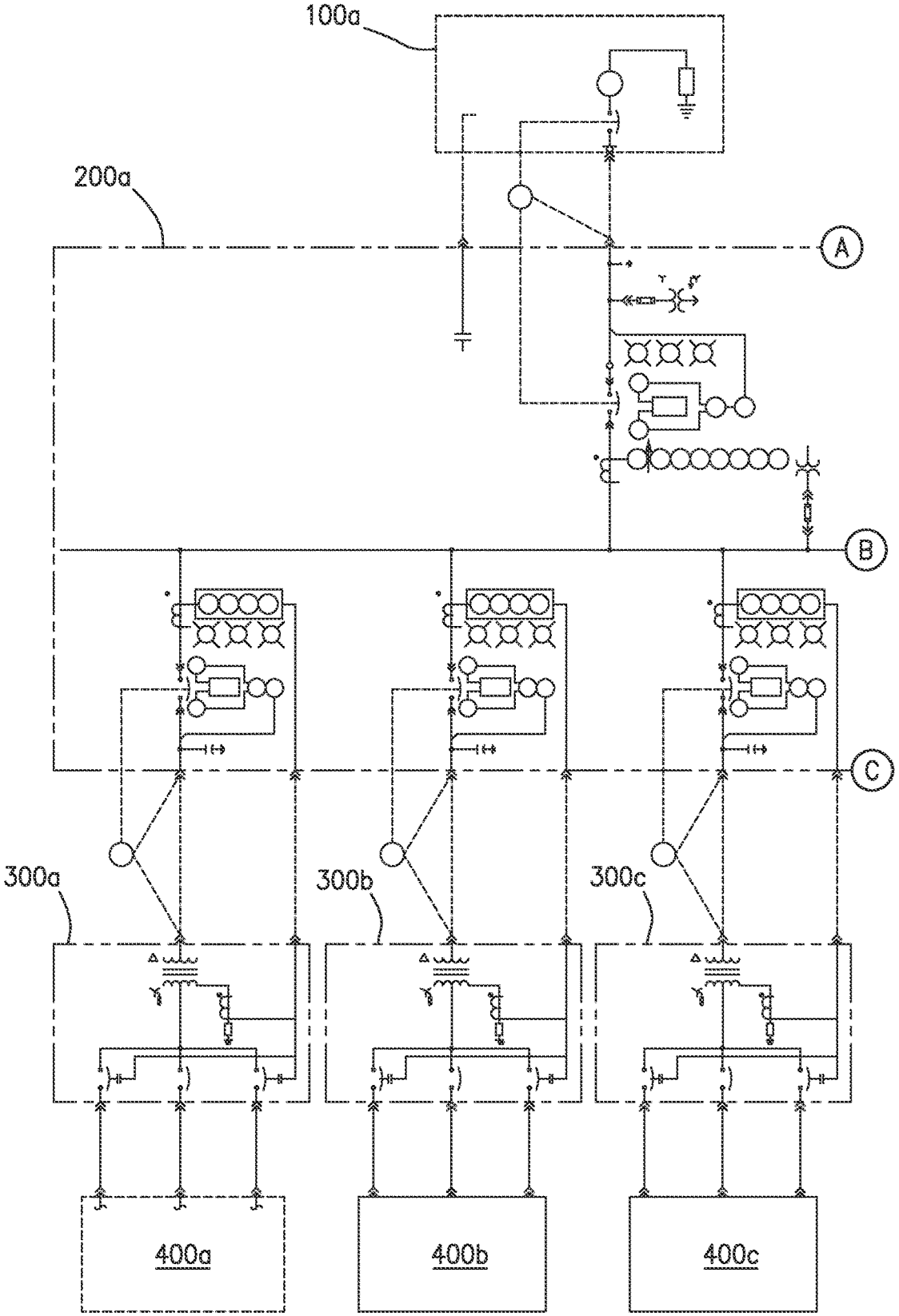
Fig.2A1

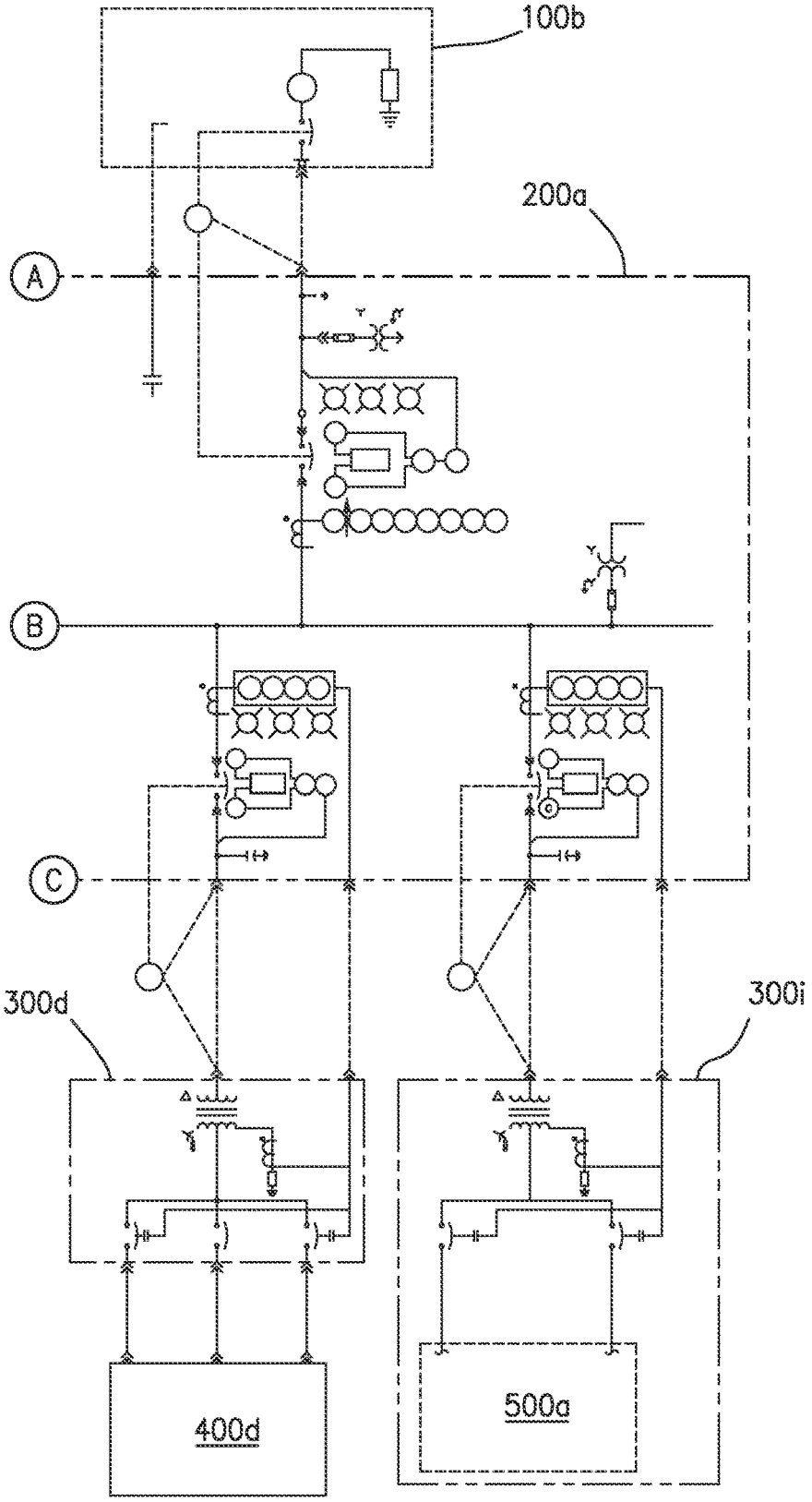
Fig.2A2

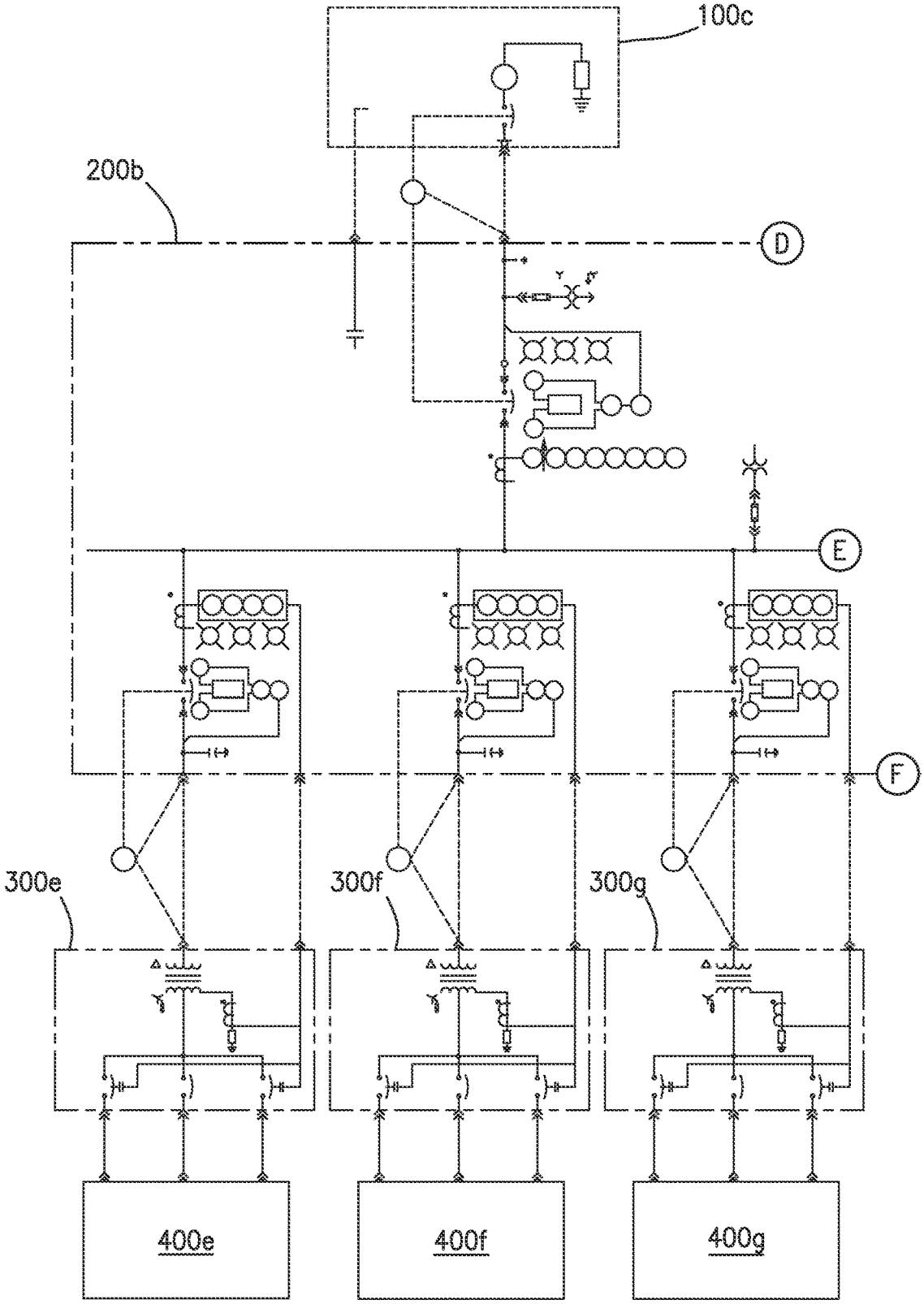
Fig.2B1

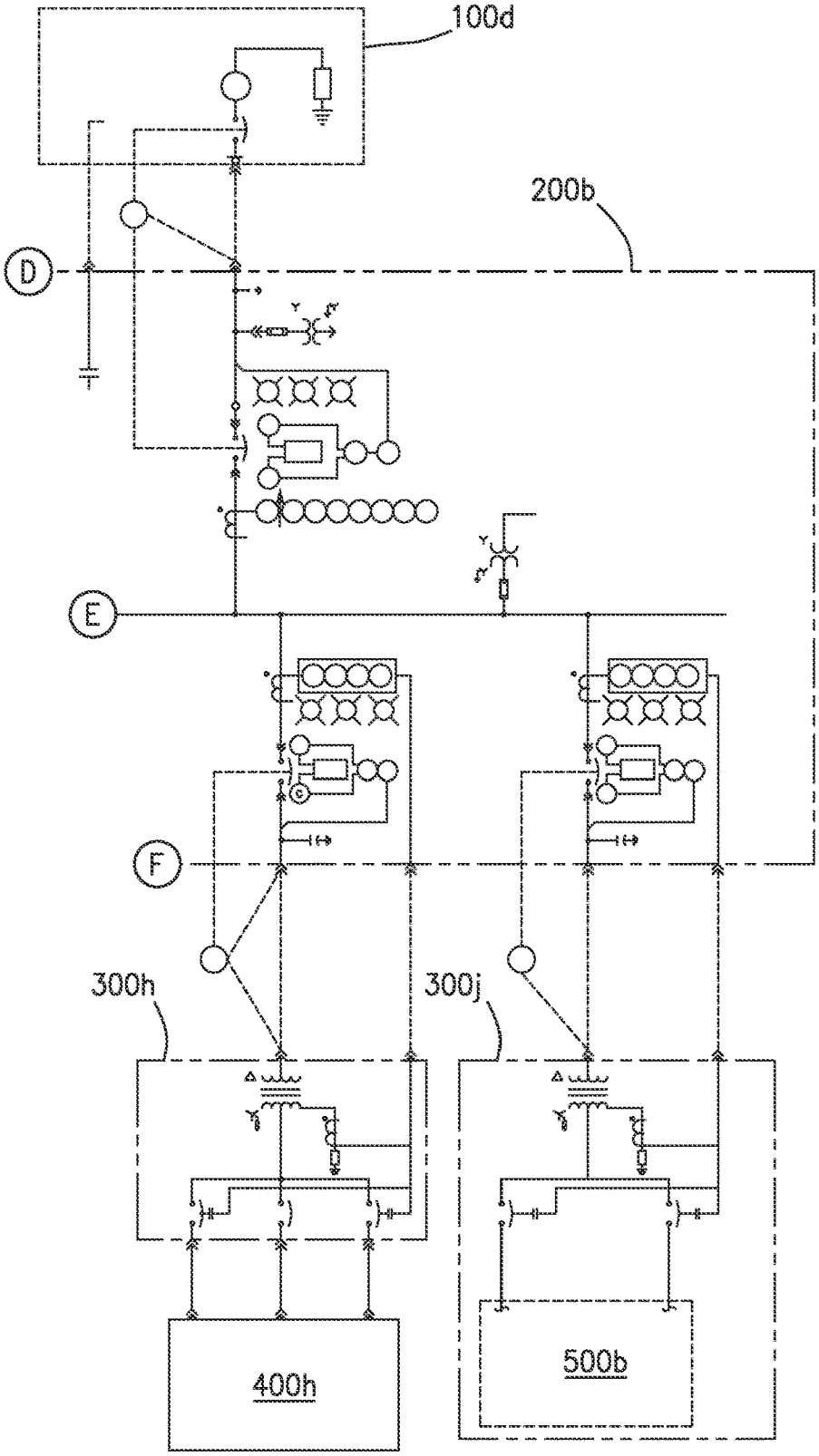
Fig.2B2

WELL FRACTURING SYSTEMS WITH ELECTRICAL MOTORS AND METHODS OF USE

CROSS-REFERENCE TO RELATED APPLICATIONS

This application is a divisional of U.S. patent application Ser. No. 16/940,257 filed Jul. 27, 2020, which is a divisional of U.S. Pat. No. 10,851,638, filed Apr. 1, 2019 which is a divisional of U.S. Pat. No. 10,246,984, filed Mar. 3, 2016, which claims the benefit of U.S. Provisional Application No. 62/128,291, filed on Mar. 4, 2015, all of which are incorporated herein by reference in its entirety for all purposes.

BACKGROUND

1. Field

The following description relates to remotely monitoring and controlling electrical motors in oil and gas well stimulation hydraulic fracturing applications. For example, an apparatus and method allows an operator to remotely monitor and control, through wired connections and/or wirelessly, one or more alternating current motors in oil and gas well stimulation hydraulic fracturing applications.

2. Description of Related Art

Hydraulic fracturing is the process of injecting treatment fluids at high pressures into existing oil or gas wells in order to stimulate oil or gas production. The process involves the high-pressure injection of "fracking fluid" (primarily water, containing sand or other proppants suspended with the aid of thickening agents) into a wellbore to create cracks in the deep-rock formations through which natural gas, petroleum, and brine will flow more freely. When the hydraulic pressure is removed from the well, small grains of hydraulic fracturing proppants (such as sand or aluminum oxide) hold the fractures open. A typical stimulation treatment often requires several high pressure fracturing pumps operating simultaneously to meet pumping rate requirements.

Hydraulic-fracturing equipment typically consists of one or more slurry blender units, one or more chemical hydration units, one or more fracturing pump units (powerful triplex or quintuplex pumps) and a monitoring unit. Associated equipment includes fracturing tanks, one or more units for storage and handling of proppant and/or chemical additives, and a variety of gauges and meters monitoring flow rate, fluid density, and treating pressure. Fracturing equipment operates over a range of pressures and injection rates, and can reach 100 megapascals (15,000 psi) and 265 litres per second (9.4 cu ft/s) (100 barrels per minute).

Hydraulic fracture treatment can be monitored by measuring the pressure and rate during the formation of a hydraulic fracture, with knowledge of fluid properties and proppant being injected into the well. This data, along with knowledge of the underground geology can be used to model information such as length, width and conductivity of a propped fracture. By monitoring the temperature and other parameters of the well, engineers can determine collection rates, and how much fracking fluid different parts of the well use.

Diesel engines have been used as the primary driving mechanism for fracturing pumps in the past. Using diesel engines, however, has serious disadvantages, including the relative inefficiency of the internal combustion engine and the fact that its operation is costly. In addition, off-road diesel engines of the types used for hydraulic fracturing are noisy while pumping, limiting the areas in which they may be used. Also, diesel engines have many moving parts and require continuous monitoring, maintenance, and diagnostics. Ancillary subsystems are typically driven hydraulically in traditional diesel-driven systems, which also contribute to other operational problems.

In view of the above deficiencies, electrical motors for hydraulic fracturing operations potentially offer an attractive alternative. Electrical motors are lighter, have fewer moving parts, and can more easily be transported. Further, the control of electrical motors provides many advantages over traditional diesel-driven, variable gear ratio powertrains, for example, through more precise, continuous speed control. During operation, electrical motors may be controlled with specific speed settings and can be incremented or decremented in single RPM (revolutions per minute) intervals without interruption. Also, automatic control operations can allow for the most efficient distribution of power throughout the entire system. The use of electrical motors obviates the need for supplying diesel fuel to more traditional fracturing pumps, and reduces the footprint of the site, and its environmental impact. Other advantages of electrical motors include, but are not limited to, the ability to independently control and operate ancillary sub systems.

Electrical motors are available in two main varieties, dependent on the methods of voltage flow for transmitting electrical energy: direct current (DC) and alternating current (AC). With DC current, the current flow is constant and always in the same direction, whereas with AC current the flow is multi-directional and variable. The selection and utilization of AC motors offers lower cost operation for higher power applications. In addition, AC motors are generally smaller, lighter, more commonly available, and less expensive than equivalent DC motors. AC motors require virtually no maintenance and are preferred for applications where reliability is critical.

Additionally, AC motors are better suited for applications where the operating environment may be wet, corrosive or explosive. AC motors are better suited for applications where the load varies greatly and light loads may be encountered for prolonged periods. DC motor commutators and brushes may wear rapidly under this condition. VFD drive technology used with AC motors has advanced significantly in recent times to become more compact, reliable and cost-effective. DC drives had a cost advantage for a number of years, but that has changed with the development of new power electronics like IGBT's (Insulated-gate bipolar transistors).

Despite the potential advantages associated with electrical motors of both types, and the continuing need for improvement, the use and control of hydraulic fracturing operations using electrical motors has not been successfully implemented in practice.

SUMMARY

This summary is provided to introduce a selection of concepts in a simplified form that are further described below in the Detailed Description. It is not intended to identify essential features of the invention, or to limit the scope of the attached claims.

In an aspect, a system for stimulating oil or gas production from a wellbore is disclosed, which includes a hydraulic fracturing pump unit having two or more fluid pumps, each fluid pump being driven by an alternating current (AC)

electrical pump motor coupled to the fluid pump, and a variable frequency drive (VFD) controlling the electrical pump motor; an electrically powered hydraulic blender unit configured to provide treatment fluid to at least one of said one or more fluid pumps for delivery to the wellbore, wherein the blender unit comprises at least one AC electrical blending motor; and a system control unit communicating with each of said hydraulic fracturing pump unit and electrically powered hydraulic blender unit, for controlling operational parameters of each of the units where the system control unit is configured to separately control parameters of each of the two or more fluid pumps of the hydraulic fracturing pump unit.

In another aspect, a system for stimulating oil or gas production from a wellbore is disclosed, which includes a hydraulic fracturing pump unit having a hydraulic fracturing pump driven by an electrical fracturing motor; a variable frequency drive (VFD) controlling the electrical fracturing motor; a fracturing pump blower unit driven by an electrical blower motor; and a fracturing pump lubrication unit comprising a lubrication pump driven by an electrical lubrication motor, and a cooling fan driven by an electrical cooling motor; an electrically powered hydraulic blender unit configured to provide treatment fluid to the hydraulic fracturing pump unit for delivery to the wellbore, the blender unit comprising at least one electrical blending motor; and a system control unit including a hydraulic fracturing pump unit controller configured to control the hydraulic fracturing pump unit; a hydraulic blender unit controller configured to control the hydraulic blender unit; and a hydration unit controller configured to control the hydration unit.

In yet another aspect, a system control unit for use with a system for stimulating oil or gas production from a wellbore is disclosed, which includes a hydraulic fracturing pump unit controller configured to control a hydraulic fracturing pump unit having one or more hydraulic fracturing electrical motors, the hydraulic fracturing pump unit controller including a hydraulic fracturing pump controller configured to control a hydraulic fracturing pump; and a hydraulic fracturing blower unit controller configured to control a hydraulic fracturing pump blower unit; and a hydraulic fracturing lubrication unit controller configured to control a hydraulic fracturing pump lubrication unit; and a hydraulic blender unit controller configured to control a hydraulic blender pump unit having one or more hydraulic blender electrical motors, the hydraulic blender pump unit controller including a blender control unit for controlling the operation of one or more blender units, a blender slurry power unit (SPU) pump control unit for controlling the operation of one or more blender SPU units, a blender SPU blower control unit for controlling the operation of one or more blender SPU blower units, and a blender blower control unit for controlling the operation of one or more blender blower units.

In an additional aspect, a method is disclosed for stimulating oil or gas production from a wellbore using an electrically powered fracturing system includes establishing a data channel connecting at least one hydraulic fracturing unit and an electrical fracturing blender with a control unit of the system; controlling, using one or more variable frequency drives (VFDs), a plurality ($N \geq 2$) of electrical fracturing motors powered by alternating current (AC) electricity to drive at least one fluid pump of the at least one hydraulic fracturing unit; controlling, using a VFD, at least one electrical blending motor powered by alternating current (AC) electricity to produce a fracturing fluid from an electrical fracturing blender; and pumping, using the at least one fluid pump driven by the plurality of electrical fracturing motors, a blended fracturing fluid down a wellbore located at the well site, where speed sets of each AC motor are controlled individually based upon at least one of a desired set of hydraulic fracturing design parameters including injection rate or pressures, pressure limits established for the individual pumps; and measured aggregate flow rate of the pumped fluid.

Other features and aspects may be apparent from the following detailed description and the drawings.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the invention is not limited to the precise arrangements and instrumentalities shown. The accompanying drawings illustrate an implementation of systems, apparatuses, and methods consistent with the present description and, together with the description, serve to explain advantages and principles consistent with the invention, as defined in the attached claims.

FIGS. 2A1-2A2 and 2B1-2B2 are diagrams illustrating an example of an electrical one line drawing for the overall well fracturing system including turbine generators, switchgear modules, transformers, electrical subsystems for one or more fracturing pump units, and electrical subsystems for one or more blender units and hydration units.

Figure 1:
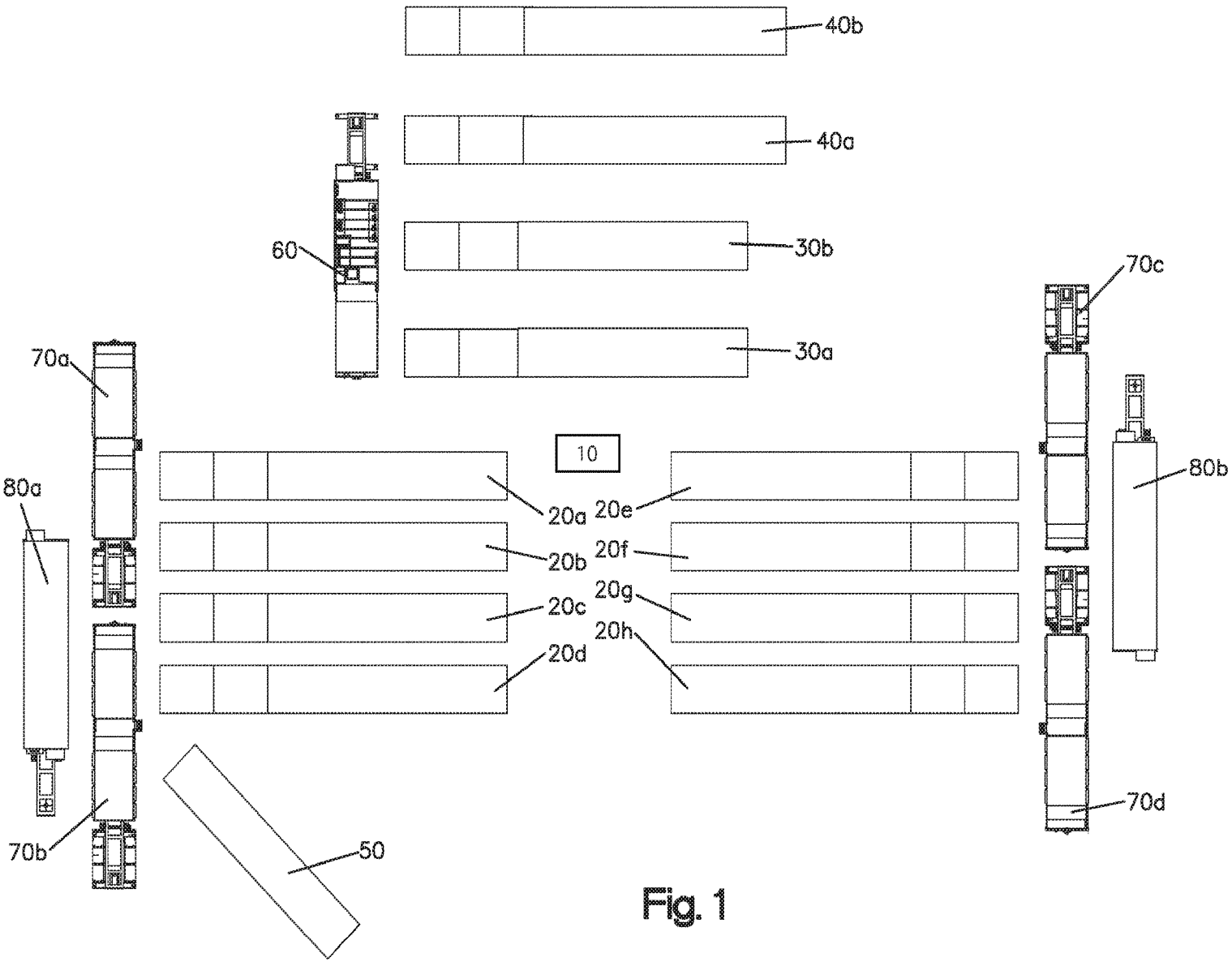
FIG. 1 is a diagram illustrating an example of a hydraulic fracturing fleet layout for a well fracturing system using electrical motors.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Various changes, modifications, and substantial equivalents of the systems, apparatuses and/or methods described herein will be apparent to those of ordinary skill in the art. In certain cases, descriptions of well-known functions and constructions have been omitted for increased clarity and conciseness.

The control of AC motors provides several advantages over traditional diesel-driven, including variable gear ratio powertrains based on the more precise, continuous speed control. During operation, the described methods and systems enable the AC motors to be controlled with specific speed settings based on a specific speed input and can be incremented or decremented in single RPM (revolutions per minute) intervals without interruption.

This following description also relates to a method to control and monitor from a remote location the previously described AC motors. A wired or wireless data channel can be established that connects the hydraulic fracturing equipment to a remote monitoring and control station. The remote monitoring and control station may include a human machine interface (HMI) that allows the AC motors' speed set points to be entered and transmitted such that the speed of the AC motors can be individually controlled. The fracturing pump units' individual pumping rates and combined manifold pressure can therefore be regulated by a remote controller operating from a distance.

In an example, the HMI may include a desktop computer, monitor, and keyboard, but can be extended to other HMI devices, such as touch enabled tablet computers and mobile phones. The HMI may be connected via a data channel to a distributed programmable automation controller (PAC) on each hydraulic fracturing unit. The PAC relays the speed set point from the operator at the HMI to a variable frequency drive (VFD). The VFD provides ac current which turns the mechanically coupled motor and fracturing pump. In this example, the PAC also acts a safety device. If an unsafe condition is detected, for example, an over pressure event, the PAC can independently override the remote operator's command and take whatever action is appropriate, for example, shutting off the VFD, In addition to the prime movers, additional AC motors provide the means for powering and controlling ancillary subsystems, such as lubrication pumps and cooling fans, which were conventionally driven hydraulically. The following description also relates to control, either manually or automatically, of any ancillary subsystem electric motors over the same data channel used to control the prime mover. Lubrication systems may be used in the overall operation of equipment in oil and gas well stimulation hydraulic fracturing application and the ability to independently control these systems through the use of AC motors is an advantage over diesel-driven engine applications.

The system supervisory control can also include a higher level automation layer that synchronizes the AC motors' operation. Using this method, an operator can enter a target injection rate and pump pressure limit, or alternatively, a target injection pressure and a pump rate limit, whereby an algorithm automatically adjusts the AC motors' speed set points to collectively reach the target quantity, while not collectively exceeding the limit quantity. This high level automation layer can operate in either open loop or closed loop control modes.

FIG. 1 illustrates an example of a hydraulic fracturing fleet layout for a well fracturing system using electrical motors. FIGS. 2A1-2A2 and 2B1-2B2 is a diagram illustrating an example of an electrical one line drawing for the overall well fracturing system.

Referring to FIGS. 1, 2A1-2A2, and 2B1-2B2 the hydraulic fracturing fleet includes fracturing pump unit trailers, trucks, or skids 20*a*, 20*b*, 20*c*, 20*d*, 20*e*, 20*f*, 20*g*, 20*h* that are positioned around a well head 10. In this example, the fracturing fleet includes eight fracturing pump unit trailers, trucks, or skids 20*a*-20*h* with each of the fracturing pump unit trailers, trucks, or skids 20*a*-20*h* including one of the eight fracturing unit control systems 400*a*, 400*b*, 400*c*, 400*d*, 400*e*, 400*f*, 400*g*, 400*h* illustrated in FIGS. 2A1-2A2 and 2B1-2B2. Adjacent to the fracturing pump unit trailers, trucks or skids 20*a*-20*h* are transformer trailers, trucks, or skids 70*a*, 70*b*, 70*c*, 70*d* that are configured to change the input voltage to a lower output voltage. In this example, four transformer trailers, trucks, or skids 70*a*-70*d* are used and each of the transformer trailers, trucks, or skids 70*a*-70*d* includes a pair of the eight fracturing transformer units 300*a*, 300*b*, 300*c*, 300*d*, 300*e*, 300*f*, 300*g*, 300*h* illustrated in FIGS. 2A1-2A2 and 2B1-2B2, one for each of the fracturing pump units 400*a*-400*h*.

Still referring to FIGS. 1, 2A1-2A2, and 2B1-2B2, the hydraulic fracturing fleet further includes a pair of switchgear trailers, trucks, or skids 80*a*, 80*b*. The switchgear trailers, trucks, or skids 80*a*, 80*b* include two switchgear modules 200*a*, 200*b* that are electrically connected to four turbine generators 100*a*, 100*b*, 100*c*, 100*d* for protecting and isolating the electrical equipment. The hydraulic fracturing fleet also includes a blender unit trailer, truck, or skid 30*a*, a backup blender unit trailer, truck, or skid 30*b*, a hydration unit trailer, truck, or skid 40*a*, and a backup hydration unit trailer, truck, or skid 40*b*. The motors and pumps for the blender and hydration units are physically on each of the respective blender and hydration unit trailers, truck, or skid 30*a*, 30*b*, 40*a*, 40*b*, while an auxiliary trailer, truck, or skid 60 houses the two blender/hydration transformer units 300*i*, 300*j* and the blender/hydration control systems 500*a*, 500*b* illustrated in FIGS. 2A1-2A2 and 2B1-2B2. Additionally, a data van or system control center 50 is provided for allowing an operator to remotely control all systems from one location.

While a specific number of units and trailers, trucks, or skids and a specific placement and configuration of units and trailers, trucks, or skids is provided, the number and position of the units is not limited to those described herein. Further, the position of a unit on a particular trailer truck, or skid is not limited to the position(s) described herein. For example, while the blender/hydration control systems 500*a*, 500*b* are described as being positioned on an auxiliary trailer, truck, or skid 60, it will be appreciated that the blender/hydration control systems 500*a*, 500*b* may be positioned directly on the respective blender and hydration unit trailers, trucks, or skids 30*a*, 30*b*, 40*a*, 40*b*. Accordingly, the figures and description of the numbers and configuration are intended to only illustrate preferred embodiments.

Figure 3:
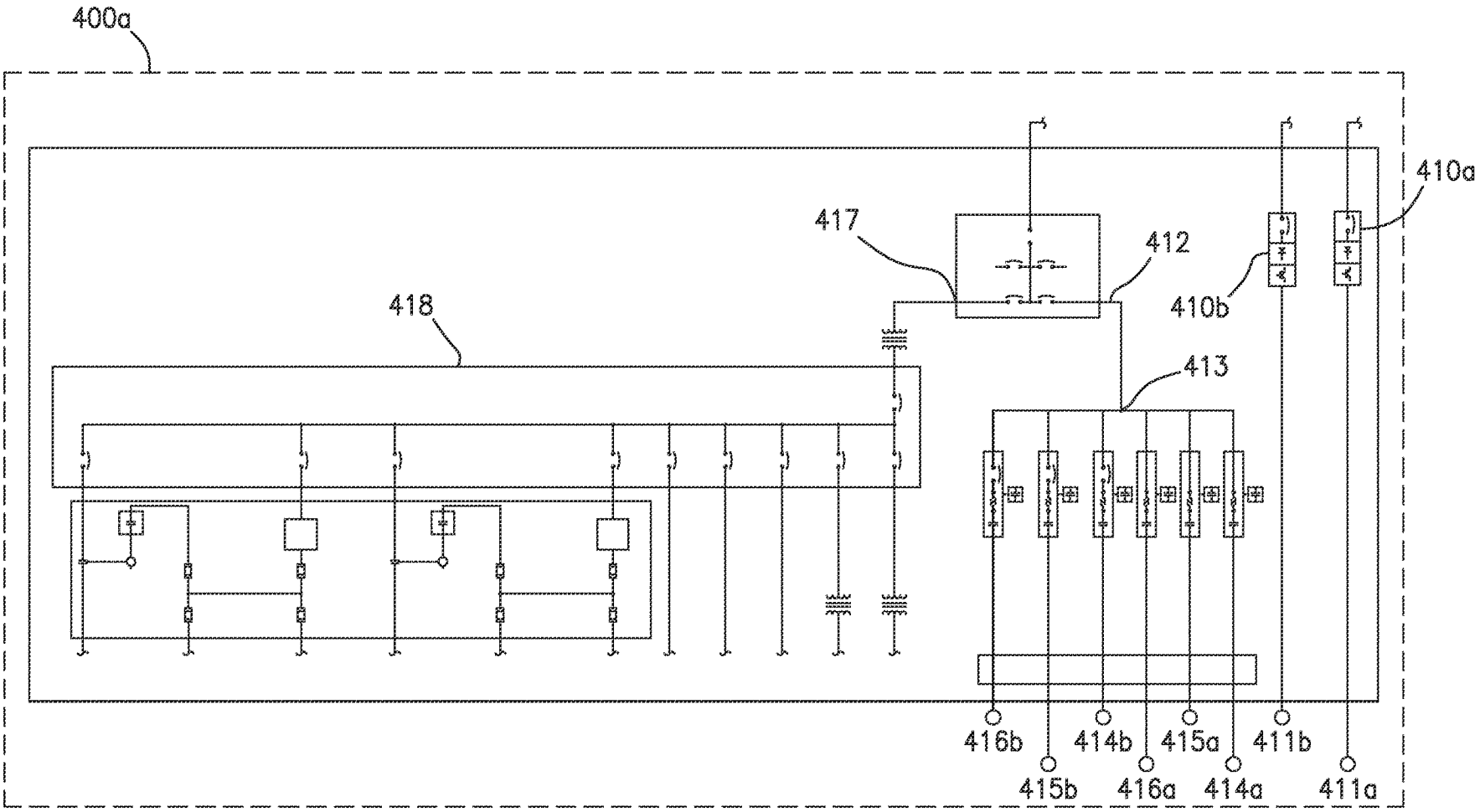
FIG. 3 is a diagram illustrating an example of an electrical diagram for a fracturing unit control system located on a fracturing trailer, truck, or skid.

FIG. 3 is a diagram illustrating an example of an electrical one line drawing for a fracturing unit control system 400*a* located on a fracturing pump unit trailer, truck, or skid 20*a*.

Referring to FIG. 3, a fracturing unit control system 400*a* includes the operating mechanisms for a fracturing pump unit 700 (described in more detail below). The operating mechanisms for the fracturing pump unit include a variable frequency drive housing that houses a first frac motor variable frequency drive ("VFD") 410*a* for driving a first frac motor 411*a*, a second frac motor VFD 410*b* for operating a second frac motor 411*b*, a power panel with a first connection 412 and a second connection 417. The first connection 412 is connected to fracturing pump unit subsystem control switches 413 for operating fracturing pump unit subsystems including first and second lubrication motors 414*a*, 414*b*, first and second cooler motors 415*a*, 415*b*, and first and second blower motors 416*a*, 416*b*. The second connection 417 is connected to a lighting panel 418 for operating miscellaneous systems including outdoor lighting, motor space heaters, and other units.

Figure 4:
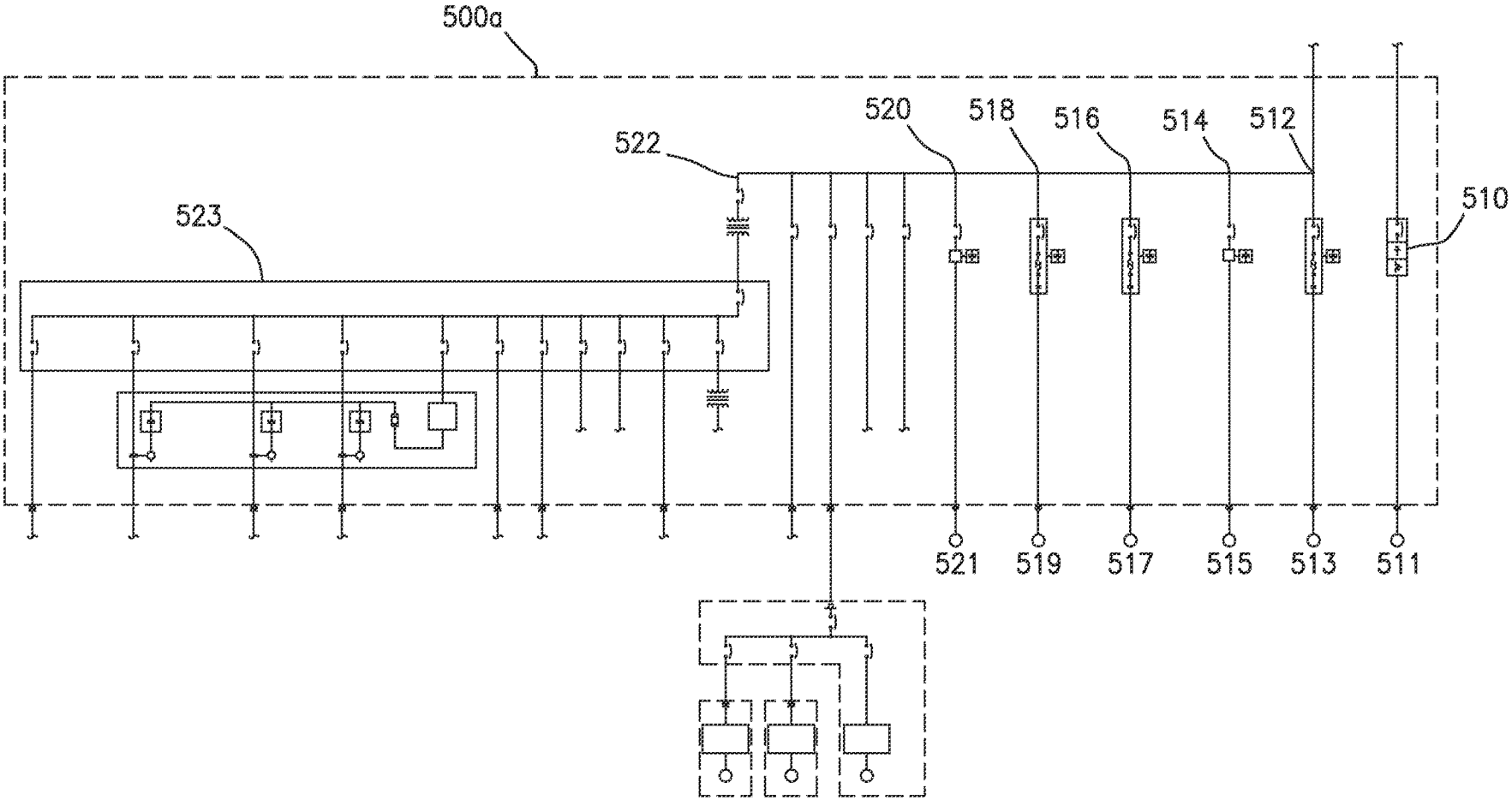
FIG. 4 is a diagram illustrating an example of an electrical diagram for a blender unit and a hydration unit control system located on an auxiliary trailer, truck, or skid.

FIG. 4 is a diagram illustrating an example of an electrical one line drawing for a blender/hydration control system 500*a* located on an auxiliary trailer, truck, or skid 60.

Referring to FIG. 4, a blender/hydration control system 500*a* includes the operating mechanisms for a blender unit 800 and a hydration unit 900 (described in more detail below). The operating mechanisms for the blender unit include a slurry power unit VFD 510 for operating a slurry power unit motor 511, a first blower control switch 512 for operating the blower motor 513 of the slurry power unit blower, a hydraulic power unit control switch 514 for operating a hydraulic power unit motor 515, and a second blower control switch 516 for operating the blower motor 517 of the hydraulic power unit blower. The operating mechanisms for the hydration unit include a hydraulic power unit control switch 518 for operating a hydraulic power unit motor 519, and a blower control switch 520 for operating the blower motor 521. In addition, the blender/hydration control system 500*a* includes a connection 522 to a lighting panel 523 for operating miscellaneous systems including lighting, motor space heaters, and other units.

Figure 5:
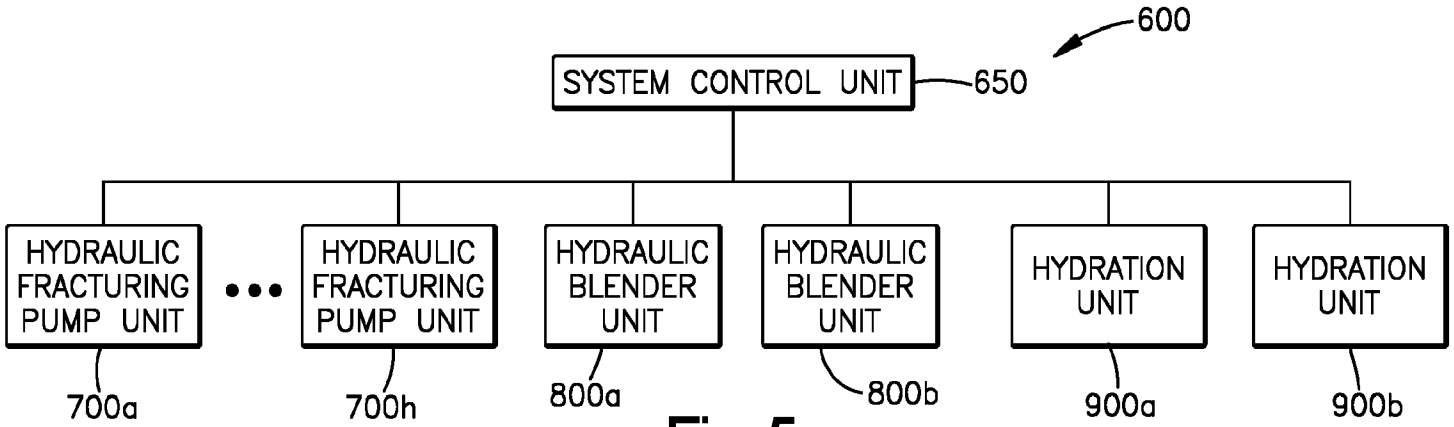
FIG. 5 is a block diagram illustrating an example of a hydraulic fracturing system for a well fracturing system using electrical motors.

FIG. 5 is a diagram illustrating an example of a hydraulic fracturing system 600 for a well fracturing system using electrical motors and including a system control unit 650.

Referring to FIG. 5, the hydraulic fracturing system 600 includes a system control unit 650, one or more hydraulic fracturing pump units 700, for example eight hydraulic fracturing pump units 700*a*-700*h*, one or more blender units 800, for example two blender units 800*a*, 800*b*. In a preferred embodiment, the system also includes one or more hydration units 900, for example two hydration units 900*a*, 900*b*. Each of the fracturing pump units 700*a*-700*h*, the blender units 800*a*, 800*b*, and the hydration units 900 may include one or more programmable automated controllers (PACs), a control/communication unit that is connected to the system control unit 650 via one or more data channels, preferably for bilateral communication.

Figure 6:
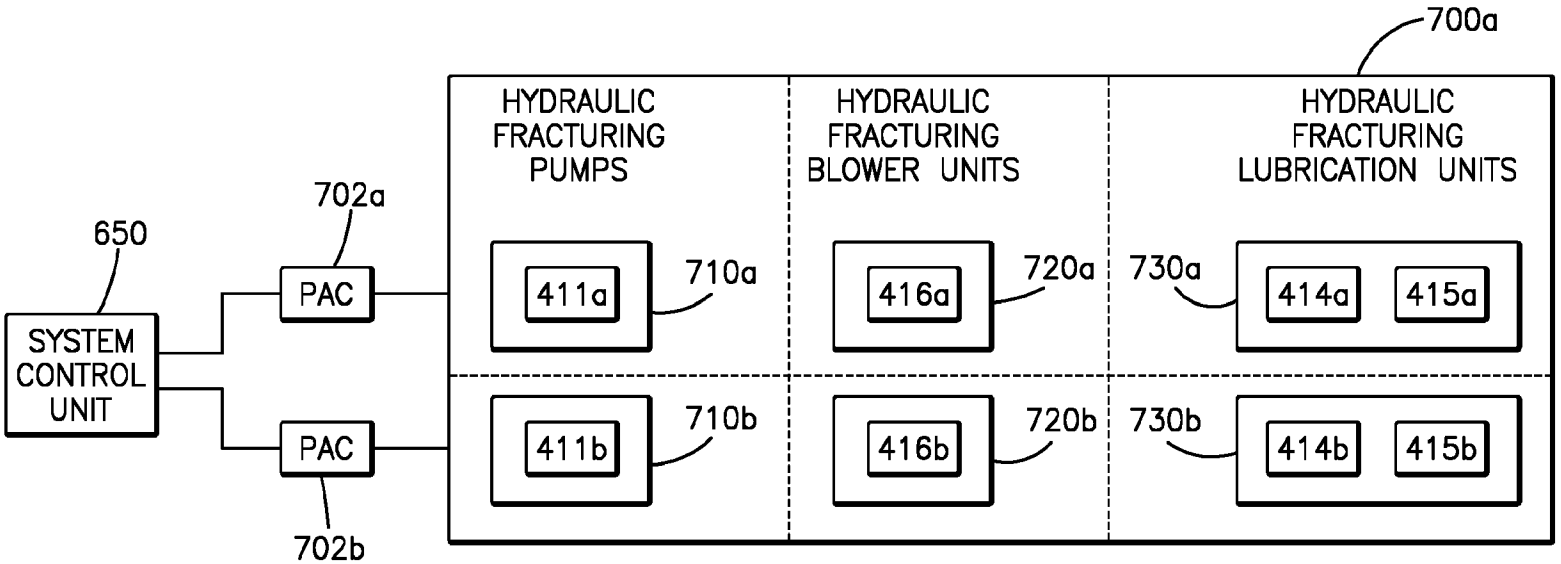
FIG. 6 is a block diagram illustrating an example of a fracturing pump unit for a well fracturing system using electrical motors.

Referring to FIG. 6, the hydraulic fracturing pump unit 700 includes one or more electric motor-driven fracturing pumps 710, for example two fracturing pumps 710*a*, 710*b*. Each fracturing pump 710*a*, 710*b* may include a corresponding blower unit 720*a*, 720*b* and a corresponding lubrication unit 730*a*, 730*b*. Each of the fracturing pumps 710*a*, 710*b* may be operated independently using a local control panel or from the system control unit 650. One or more PACs 702*a*, 702*b* may be used by the fracturing pumps 710*a*, 710*b* and/or the blower units and lubrication units to communicate with the system control unit 650. The positioning of the PACs in FIG. 6 is for illustration purposes only, it will be understood that physically each PAC can be located proximate to the respective unit.

As described above in reference to FIG. 3, the frac motor 411*a* of a fracturing pump 710*a* is controlled by a frac VFD 410*a*. The control system provides a RUN/STOP signal to the VFD 410*a* to control the status of the frac motor 411*a*. The control system provides a speed request signal to the VFD 410*a* to control the speed of the frac motor 411*a*. The motor speed is displayed and can be controlled locally and remotely.

A normal stop (RUN/STOP) will control each fracturing pump unit 700*a* independently (for example, a first fracturing pump 710*a* and a second fracturing pump 710*b* on the same frac trailer, truck, or skid 20*a* will each be controlled independently). An e-stop will be supplied to stop an entire fracturing pump unit 700*a* (i.e. the frac VFDs 410*a*, 410*b* and the frac motors 411*a*, 411*b* of a first and second pumps 710*a*, 710*b* on the trailer, truck, or skid 20*a* are shut down). A master e-stop will be supplied to shut down all deployed fracturing pump units 700*a*-700*h* (i.e. all VFDs and all motors on all trailers, trucks, or skids 20*a*-20*h* are shut down).

Included in the remote control method is an automated alarm management system, such that if any operating parameter exceeds its normal range, an indicator will be overlaid at the system control unit 650 to alert the operator. The operator can then choose what action to take, for example, bringing the affected unit offline. The alarm management system can be extended to suggest to the operator the appropriate response(s) to the alarm event, and what options exist. One benefit of the automated alarm management system is that multiple processes and subsystems on each pumping unit can be monitored autonomously, thus enabling an operator to focus on primary objectives, that is, pumping rates and pressures, while ensuring safe operation across multiple pumping units 700*a*-700*h*.

The frac VFD 410*a* provides a VFD FAULT contact to the control system to indicate if a fault condition is present, and the control system provides local/remote alarm indication of the VFD FAULT. In case a VFD FAULT occurs, the system control unit 650 of the data van 50 will display a generic fault warning. The VFD FAULT can be reset based on predefined intervals of time from the data van 50; if a VFD FAULT occurs more frequently than the predefined interval then, in an example, that VFD FAULT can only be reset from the frac VFD 410.

The frac motor 411*a* contains a space heater to help ensure that the motor windings are dry before operation. Typical practice is to have the space heaters energized for at least 24-hours before running the motor. The space heater has two (2) operating modes: AUTO and OFF. In AUTO mode the heater is turned on when the control system is energized and the pump-motor is OFF. The heater is turned off whenever the pump-motor is commanded to RUN. The heater is turned on again anytime the pump-motor is stopped (Normal Stop). If an Emergency Stop occurs, the heat is turned off immediately.

In an example, the hydraulic fracturing pump unit 700*a* may be supplied with a multi-color light tower for each pump 710*a*, 710*b*. The beacon lights illuminate (steady) based on the following: Color 1: frac motor 411*a* is not running and is not enabled to run; Color 2: frac motor 411*a* is running OR has been enabled to run; Color 3: the pump discharge pressure for the frac motor 411*a* is greater than a pre-defined psig setpoint.

In an example, one or more resistance temperature detectors (RTDs) may be placed onto each AC frac motor 411*a*; on each of three phase windings, on the front motor bearing(s), and on the rear motor bearing(s). In the example where twenty (20) or more pumps 710*a*, 710*b* are used simultaneously, the AC frac motor 411*a* temperatures alone may represent 100+ operational values, an otherwise overwhelming quantity that the automated alarm management system renders workable.

In a preferred embodiment, the frac motors 411*a* may have multiple bearings, each with a temperature sensor. The bearing temperatures may be displayed locally and remotely. If either bearing temperature of the frac motor 411*a* reaches a programmed alarm setpoint, the control system should indicate an alarm. The alarm is latched until the Alarm Reset switch is operated. If either bearing temperature of the frac motor 411*a* reaches a programmed setpoint at which the bearing could sustain damage, the control system should activate/indicate a shutdown. The shutdown is latched until the Alarm Reset switch is operated.

In a preferred embodiment, the frac motor 411*a* also has multiple windings (one for each AC phase) each with a temperature sensor. The windings are labeled in accordance to the AC phases. The winding temperatures may be displayed locally and remotely. If any winding temperature reaches a programmed alarm setpoint, the control system should indicate an alarm. The alarm is latched until the Alarm Reset switch is operated. If any winding temperature reaches a programmed setpoint at which the winding could sustain damage, the control system should activate/indicate a shutdown. The shutdown is latched until the Alarm Reset switch is operated.

In this example, a hydraulic fracturing pump 710*a* may include a pressure transmitter that provides a signal for the pump discharge pressure. The pump discharge pressure is displayed locally and remotely at the system control unit 650. An Overpressure setpoint can be adjusted on the control system that is triggered by the pump discharge pressure. If the pump discharge pressure exceeds the Overpressure setpoint, the control system stops the frac motor 411*a* via the RUN/STOP control to the frac VFD 410*a*. The control system should activate/indicate a shutdown. The Overpressure shutdown is latched until the Alarm Reset switch is operated.

Still referring to FIG. 6, the hydraulic fracturing pump unit 700*a* also includes a frac motor blower unit 720*a*, 720*b* for each of the fracturing pumps 710*a*, 710*b*.

The frac motor 411*a* has an electric motor-driven blower unit 720*a* for cooling the frac motor 411*a*. The blower motor 416*a*, described above in reference to FIG. 3, has multiple operating modes: AUTO, MANUAL and OFF. In AUTO mode the blower motor 416*a* is started any time the frac motor 411*a* is running and remains on for a "cool down" period based on a predefined interval of time after the frac motor 411*a* is stopped (Normal Stop). If an Emergency Stop occurs, the blower motor 416*a* stops immediately and there is not a "cool down" period. In MANUAL mode the blower motor 416*a* runs continuously, regardless of the pump-motor's status. In OFF mode the blower motor 416*a* does not run, regardless of the frac motor's 411*a* status.

The blower unit 720*a* includes a pressure switch that senses the blower outlet pressure to confirm that the blower unit 720*a* is operating satisfactorily. Any time that the blower unit 720*a* is running, the pressure switch should be activated. If the blower unit 720*a* is running and the pressure switch is NOT activated, then the control system of the system control unit 650 should indicate an alarm. The alarm is latched until the Alarm Reset switch is operated.

Still referring to FIG. 6, the hydraulic fracturing pump unit 700*a* also includes a frac motor lubrication unit 730*a*, 730*b* for each of the fracturing pumps 710*a*, 710*b*.

Each frac motor lubrication unit 730*a*, 730*b* includes a lubrication pump operated by an electrical lubrication motor 414*a*, a cooling fan operated by a cooler motor 415*a*, a pressure transmitter and a temperature transmitter. Any time the control system commands the frac VFD 410*a* to RUN it first turns on the lubrication pump 414*a*, confirms lubrication oil pressure is greater than a predefined PSIG setpoint, then enables the frac VFD 410*a* to start the frac motor 411*a*. Whenever the control system commands the frac VFD 410*a* to STOP, it also turns off the lubrication pump and lubrication motor 414*a* following the same "cool down" period described above for the motor blower control.

Any time the control system commands the frac VFD 410*a* to RUN, the lubrication system cooling fan and cooling motor 415*a* is enabled to run. Once the lubrication temperature reaches a predefined temperature maximum threshold, the control system turns on the cooling fan and cooling motor 415*a*. Whenever the lubrication temperature is below a predefined temperature midrange minimum threshold, the control system turns the cooling fan and cooling motor 415 off. The fan is also turned off whenever the lubrication pump and lubrication motor 414*a* are turned off.

If an Emergency Stop occurs, the lubrication motor 414*a* and cooling fan motor 415*a* are stopped immediately and there is not a "cool down" period. When enabled to run, if the lubrication temperature exceeds a predefined threshold or lubrication pressure falls below a predefined PSIG setpoint, the control system should indicate an alarm. The alarm is latched until the Alarm Reset switch is operated. When enabled to run, if the lubrication pressure is below a minimum predefined PSIG set point for a predefined time interval, the control system should activate/indicate a shutdown. The shutdown is latched until the Alarm Reset switch is operated. In this example, the lubrication system pressure and temperature are both displayed locally and remotely at the system control unit 650.

The shutdowns described for the hydraulic fracturing pump unit 700*a* can be enabled/disabled via a master override setting at the local or remote system control unit 650. When shutdowns are disabled the control system still provides a visual indicator advising the operator to manually shut the unit down. When shutdowns are enabled, the unit is shut down automatically without operator intervention.

Figure 7:
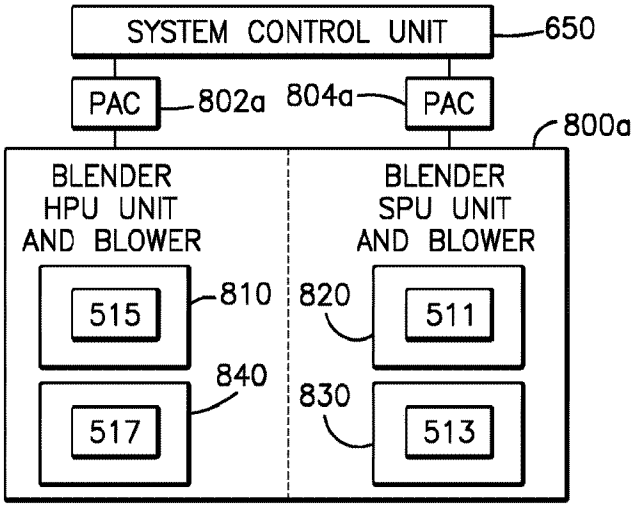
FIG. 7 is a block diagram illustrating an example of a blender unit for a well fracturing system using electrical motors.

FIG. 7 is a diagram illustrating an example of a hydraulic fracturing blender unit 800A for a well fracturing system using electrical motors. The blender unit generally functions to prepare the slurries and gels used in stimulation treatments by the overall system. In a preferred embodiment, it is computer controlled, enabling the flow of chemicals and ingredients to be efficiently metered and to exercise control over the blend quality and delivery rate.

Referring to FIG. 7, the hydraulic fracturing blender unit 800*a* may include two or more electric motor-drives that may be operated independently using a local control panel or from the system control unit 650. One motor, the hydraulic power unit motor 515, drives a hydraulic power unit 810 and the other, a slurry power unit motor 511, a slurry power unit 820. One or more PACs 802*a*, 802*b* may be used by the hydraulic power unit and blower 810, 840 and the slurry power unit and blower 820, 830 to communicate with the system control unit 650.

The slurry power unit ("SPU") motor 511 is controlled by the slurry power unit VFD 510. The control system provides a RUN/STOP signal to the slurry power unit VFD 510 to control the status of the SPU motor 511. The control system provides a speed request signal to the slurry power unit VFD 510 that allows the speed of the motor 511 to be varied across the entire speed range. The motor 511 speed is displayed and can be controlled locally.

The slurry power unit VFD 510 provides a VFD FAULT contact to the control system to indicate if a fault condition is present, and the control system provides local/remote alarm indication of the VFD FAULT. The VFD FAULT can be reset based on predefined intervals of time from the data van 50; if a VFD FAULT occurs more frequently than the predefined interval then, in an example, that VFD FAULT can only be reset from the VFD The SPU motor 511 may include a space heater to help ensure that the motor windings are dry before operation. Typical practice is to have the space heaters energized at least for 24-hours before running the motor. The space heater has multiple operating modes: AUTO and OFF. In AUTO mode the heater is turned on the control system is energized and the SPU motor 511 is OFF. The heater is turned off whenever the SPU motor 511 is commanded to RUN. The heater is turned on again anytime the SPU motor is stopped (Normal Stop). If an Emergency Stop occurs, the heat is turned off immediately.

In a preferred embodiment, the SPU motor 511 may have multiple bearings, each with a temperature sensor. The bearing temperatures are displayed locally and remotely. If either bearing temperature reaches a programmed alarm setpoint, the control system should indicate an alarm. The alarm is latched until the Alarm Reset switch is operated. If either bearing temperature reaches a programmed setpoint at which the bearing could sustain damage, the control system should activate/indicate a shutdown. The shutdown is latched until the Alarm Reset switch is operated.

In a preferred embodiment, the SPU motor 511 also has multiple windings (one for each AC phase) each with a temperature sensor. The windings are labeled A, B and C corresponding to the AC phases. The winding temperatures are displayed locally and remotely. If any winding temperature reaches a programmed alarm setpoint, the control system should indicate an alarm. The alarm is latched until the Alarm Reset switch is operated. If any winding temperature reaches a programmed setpoint at which the winding could sustain damage, the control system should activate/indicate a shutdown. The shutdown is latched until the Alarm Reset switch is operated.

Still referring to FIG. 7, the hydraulic fracturing blender unit 800*a* also includes a hydraulic power unit 810. In a preferred example, the hydraulic power unit (HPU) motor 515 is operated at a fixed speed. The control system provides a RUN/STOP signal to the motor control center (MCC) to control the status of the HPU motor 515. The motor speed is fixed; the motor can be controlled On/Off locally.

The HPU motor 515 may include a space heater to help ensure that the motor windings are dry before operation. The space heaters may be energized at least for 24-hours before running the motor. The space heater has two (2) operating modes: AUTO and OFF. In AUTO mode the heater is turned on the control system is energized and the HPU motor is OFF. The heater is turned off whenever the HPU motor 515 is commanded to RUN. The heater is turned on again anytime the HPU motor 515 is stopped (Normal Stop). If an Emergency Stop occurs, the heat is turned off immediately.

In a preferred embodiment, the HPU motor 515 may have multiple bearings, each with a temperature sensor. The bearing temperatures are displayed locally and remotely. If either bearing temperature reaches a programmed alarm setpoint, the control system should indicate an alarm. The alarm is latched until the Alarm Reset switch is operated. If either bearing temperature reaches a programmed setpoint at which the bearing could sustain damage, the control system should activate/indicate a shutdown. The shutdown is latched until the Alarm Reset switch is operated.

In a preferred embodiment, the HPU motor 515 also has multiple windings (one for each AC phase) each with a temperature sensor. The windings are labeled A, B and C corresponding to the AC phases. The winding temperatures are displayed locally and remotely. If any winding temperature reaches a programmed alarm setpoint, the control system should indicate an alarm. The alarm is latched until the Alarm Reset switch is operated. If any winding temperature reaches a programmed setpoint at which the winding could sustain damage, the control system should activate/indicate a shutdown. The shutdown is latched until the Alarm Reset switch is operated.

Still referring to FIG. 7, the hydraulic fracturing blender unit 800*a* also includes an SPU electric motor-driven blower unit 830 and an HPU electric motor-driven blower unit 840.

The SPU motor 511 has an SPU electric motor-driven blower 830 for cooling the SPU motor 511. The SPU blower motor 513, described above in reference to FIG. 4, has multiple operating modes: AUTO, MANUAL and OFF. In AUTO mode the SPU blower motor 513 is started any time the SPU motor 511 is running and remains on for a "cool down" period based on a predefined interval of time after the SPU motor 511 is stopped (Normal Stop). If an Emergency Stop occurs, the SPU blower motor 513 stops immediately and there is not a "cool down" period. In MANUAL mode the SPU blower motor 513 runs continuously, regardless of the SPU motor's 511 status. In OFF mode the SPU blower motor 513 does not run, regardless of the SPU motor's 511 status.

The SPU blower unit 830 includes a pressure switch that senses the blower outlet pressure to confirm that the SPU blower unit 830 is operating satisfactorily. Any time that the SPU blower unit 830 is running, the pressure switch should be activated. If the SPU blower unit 830 is running and the pressure switch is NOT activated, then the control system of the system control unit 650 should indicate an alarm. The alarm is latched until the Alarm Reset switch is operated.

The HPU motor 515 has an HPU electric motor-driven blower unit 840 for cooling the HPU motor 515. The HPU blower motor 517, described above in reference to FIG. 4, has multiple operating modes: AUTO, MANUAL and OFF. In AUTO mode the HPU blower motor 517 is started any time the HPU motor 515 is running and remains on for a "cool down" period based on a predefined interval of time after the HPU motor 515 is stopped (Normal Stop). If an Emergency Stop occurs, the HPU blower motor 517 stops immediately and there is not a "cool down" period. In MANUAL mode the HPU blower motor 517 runs continuously, regardless of the HPU motor's 515 status. In OFF mode the HPU blower motor 517 does not run, regardless of the HPU motor's 515 status.

The HPU blower unit 840 includes a pressure switch that senses the blower outlet pressure to confirm that the HPU blower unit 840 is operating satisfactorily. Any time that the HPU blower unit 840 is running, the pressure switch should be activated. If the HPU blower unit 840 is running and the pressure switch is NOT activated, then the control system of the system control unit 650 should indicate an alarm. The alarm is latched until the Alarm Reset switch is operated.

The shutdowns described for the hydraulic fracturing blender unit 800*a* can be enabled/disabled via a master override setting at the local or remote system control unit 650. When shutdowns are disabled the control system still provides a visual indicator advising the operator to manually shut the unit down. When shutdowns are enabled, the unit is shut down automatically without operator intervention.

Figure 8:
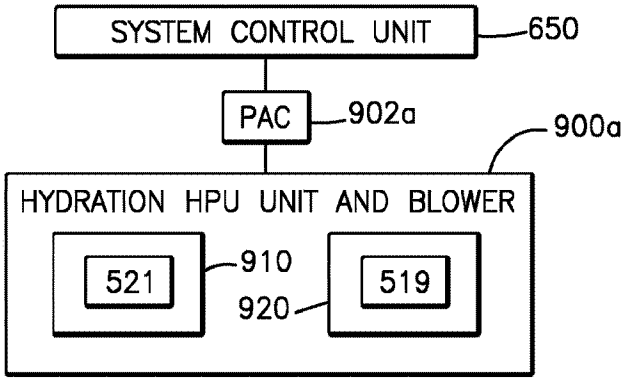
FIG. 8 is a block diagram illustrating an example of a hydration unit for a well fracturing system using electrical motors.

FIG. 8 is a diagram illustrating an example of a hydraulic fracturing hydration unit 900A for a well fracturing system using electrical motors. This unit is used in a preferred embodiment of the system and generally functions to mix water and chemical additives to make the frac fluid. The chemical additives, such as guar gum (also found in many foods), are added to help the water to gel. The mixing process in the hydration unit takes a few minutes, allowing for the water to gel to the right consistency.

Referring to FIG. 8, the hydraulic fracturing hydration unit 900*a* contains one or more electric motor-drives that can be operated from a local control panel or from the system control unit 650. One or more PACs 902*a* may be used by a hydration HPU unit and blower 910, 920 to communicate with the system control unit 650.

The hydraulic fracturing hydration unit 900*a* also includes a hydration blower unit 920. The hydration HPU motor 521 has an electric motor-driven hydration HPU blower unit 920 for cooling the hydration HPU motor 521. The hydration HPU blower motor 519 has three (3) operating modes: AUTO, MANUAL and OFF. In AUTO mode the hydration HPU blower motor 519 is started any time the hydration HPU motor 521 is running and remains on for a "cool down" period based on a predefined interval of time after the hydration HPU motor 521 is stopped (Normal Stop). If an Emergency Stop occurs, the hydration HPU blower motor 519 stops immediately and there is not a "cool down" period. In MANUAL mode the hydration HPU blower motor 519 runs continuously, regardless of the hydration HPU motor's 521 status. In OFF mode the hydration HPU blower motor 519 does not run, regardless of the hydration HPU motor's 521 status.

The hydration HPU blower motor 519 includes a pressure switch that senses the blower outlet pressure to confirm that the blower is operating satisfactorily. Any time that the blower is running, the pressure switch should be activated. If the blower is running and the pressure switch is NOT activated, then the control system should indicate an alarm. The alarm is latched until the Alarm Reset switch is operated.

The hydration HPU motor 521 may include a space heater to help ensure that the motor windings are dry before operation. The space heaters may be energized at least for 24-hours before running the hydration HPU motor 521. The space heater has two (2) operating modes: AUTO and OFF. In AUTO mode the heater is turned on the control system is energized and the hydration HPU motor 521 is OFF. The heater is turned off whenever the hydration HPU motor 521 is commanded to RUN. The heater is turned on again anytime the hydration HPU motor 521 is stopped (Normal Stop). If an Emergency Stop occurs, the heat is turned off immediately.

In a preferred embodiment, the hydration HPU motor 521 may have multiple bearings, each with a temperature sensor. The bearing temperatures are displayed locally and remotely. If either bearing temperature reaches a programmed alarm setpoint, the control system should indicate an alarm. The alarm is latched until the Alarm Reset switch is operated. If either bearing temperature reaches a programmed setpoint at which the bearing could sustain damage, the control system should activate/indicate a shutdown. The shutdown is latched until the Alarm Reset switch is operated.

In a preferred embodiment, the hydration HPU motor 521 may also have multiple windings (one for each AC phase) each with a temperature sensor. The windings are labeled A, B and C corresponding to the AC phases. The winding temperatures are displayed locally and remotely. If any winding temperature reaches a programmed alarm setpoint, the control system should indicate an alarm. The alarm is latched until the Alarm Reset switch is operated. If any winding temperature reaches a programmed setpoint at which the winding could sustain damage, the control system should activate/indicate a shutdown. The shutdown is latched until the Alarm Reset switch is operated.

The shutdowns described for the hydraulic fracturing hydration unit 900A can be enabled/disabled via a master override setting at the local or remote system control unit 650. When shutdowns are disabled the control system still provides a visual indicator advising the operator to manually shut the unit down. When shutdowns are enabled, the unit is shut down automatically without operator intervention.

Figure 9:
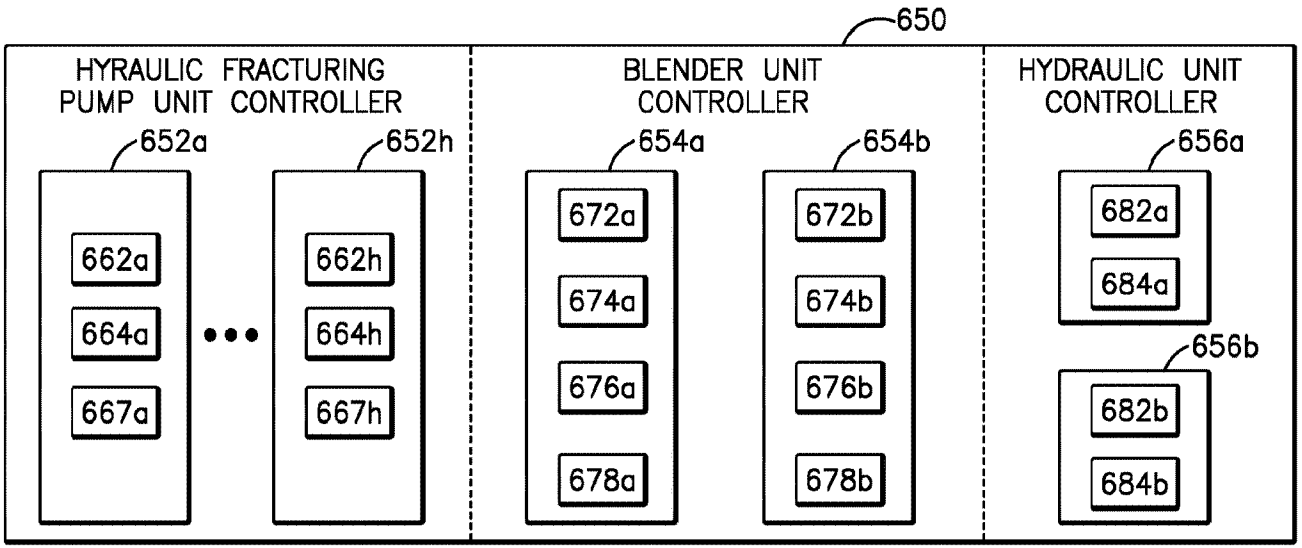
FIG. 9 is a diagram illustrating an example of a system control unit for controlling a well fracturing system using electrical motors.

FIG. 9 is a diagram illustrating an example of a system control unit 650 for controlling a well fracturing system using electrical motors.

In a preferred embodiment, a system control unit 650 is a single point control unit for remotely operating a well fracturing system. The single point remote operation of the well fracturing system allows an operator to remotely control all of the units of the well fracturing system from a single, remote location such as a data van 50.

Referring to FIG. 9, the system control unit 650 includes one or more fracturing control units 652*a*-652*h*, one or more fracturing blender control units 654*a*, 654*b*, and one or more fracturing hydration control units 656*a*, 656*b*. In this example, the system control unit 650 includes eight fracturing control units 652*a*-652*h*, two fracturing blender control units 654*a*, 654*b*, and two fracturing hydration control units 656*a*, 656*b*

The fracturing control unit 652*a* includes a fracturing pump control unit 662*a* for controlling the operation of one or more fracturing pumps 710*a*, 710*b*, a fracturing blower control unit 664*a* for controlling the operation of one or more fracturing blower units 720*a*, 720*b*, and a lubrication control unit 664*a* for controlling the operation of one or more lubrication units 730*a*, 730*b*.

The fracturing blender control unit 654*a* includes a blender HPU pump control unit 672*a* for controlling the operation of one or more blender HPU units 810, a blender SPU pump control unit 674*a* for controlling the operation of one or more blender SPU units 820, a blender SPU blower control unit 676*a* for controlling the operation of one or more blender SPU blower units 830, a blender HPU blower control unit 678*a* for controlling the operation of one or more blender HPU blower units 840.

The fracturing hydration control unit 656*a* includes a hydration HPU pump control unit 682*a* for controlling the operation of one or more hydration HPU units 910, and a blender HPU blower control unit 684*a* for controlling the operation of one or more hydration HPU blower units 920.

Figure 10:
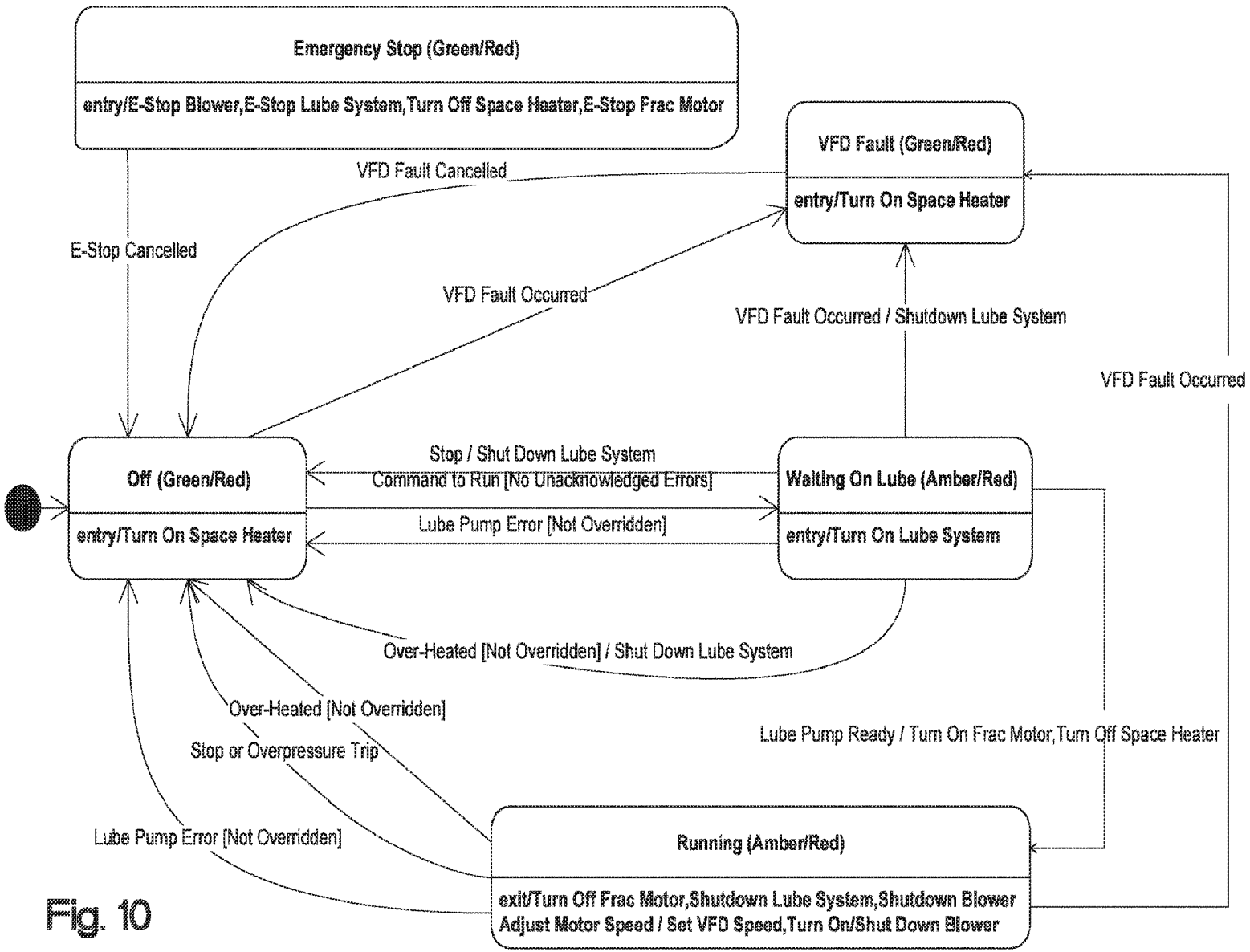
FIG. 10 is a diagram illustrating an example of a fracturing pump motor control state chart.
Figure 11:
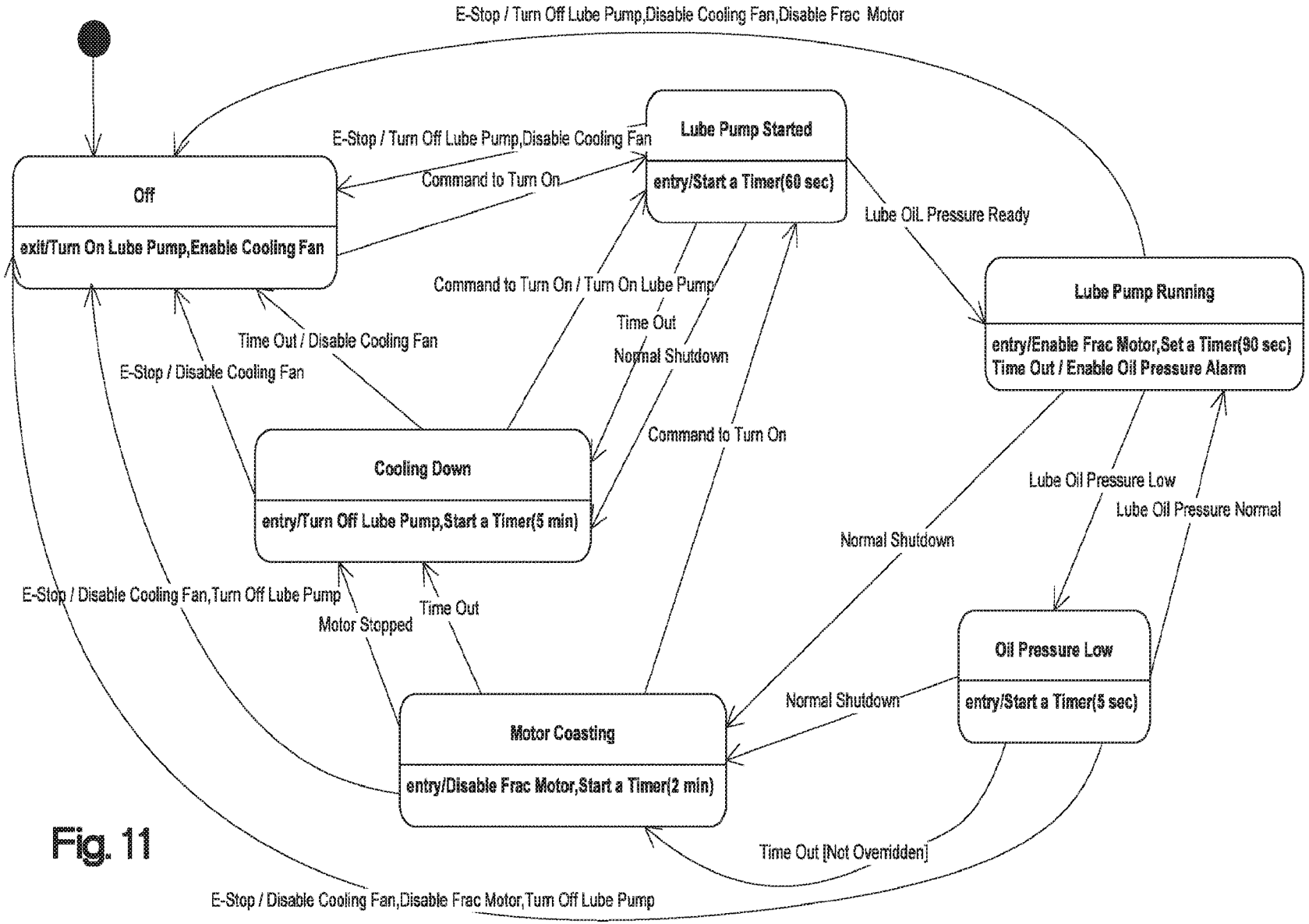
FIG. 11 is a diagram illustrating an example of a lubrication system control state chart.
Figure 12:
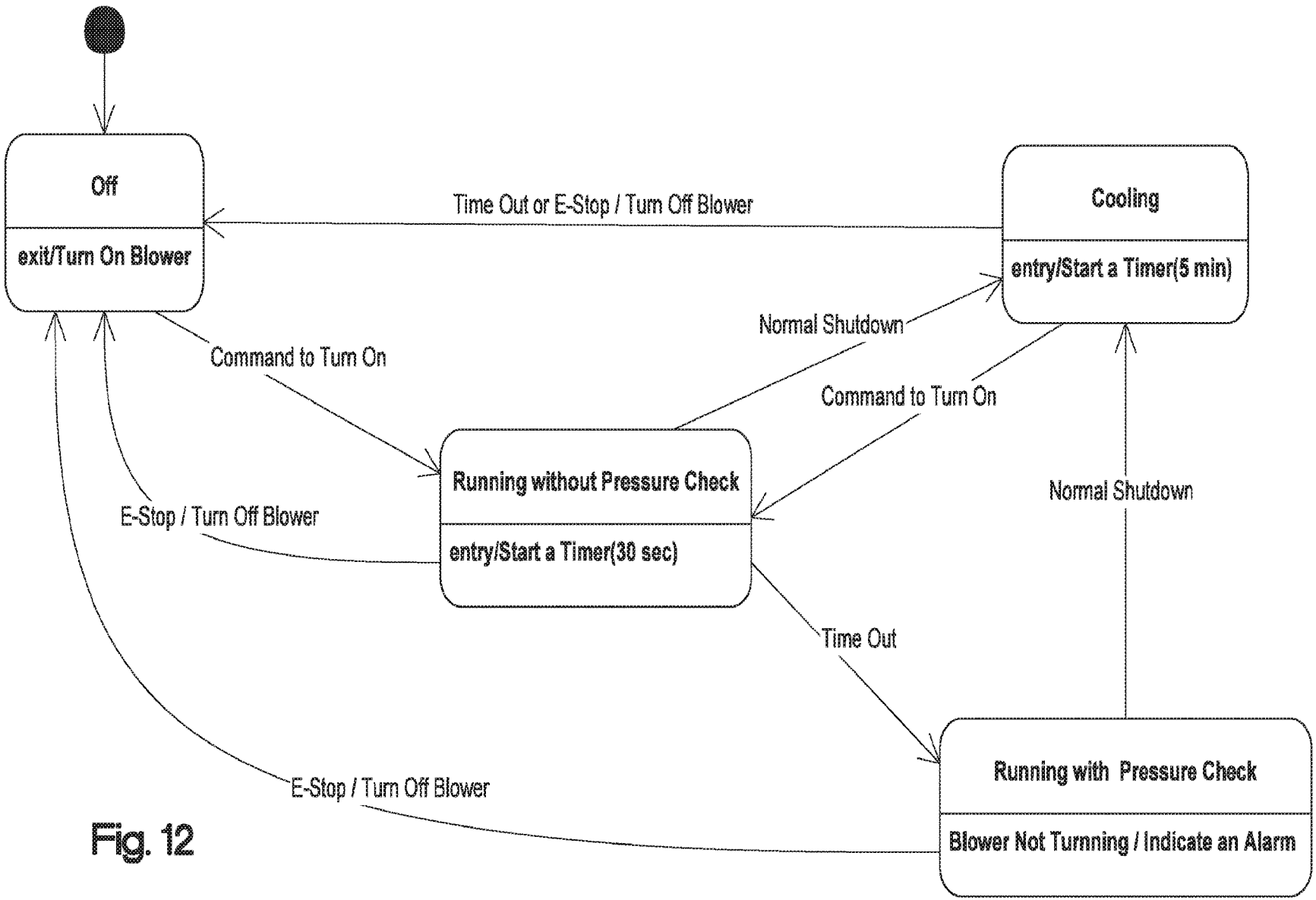
FIG. 12 is a diagram illustrating an example of motor blower control state chart.

FIG. 10 is a diagram illustrating an example of a fracturing pump motor control state chart. FIG. 11 is a diagram illustrating an example of a lubrication system control state chart. FIG. 12 is a diagram illustrating an example of motor blower control state chart.

Referring to the control state charts illustrated in FIGS. 10-12, in an example, the automatic and/or manual control operations of one or more of the hydraulic fracturing pump units 700*a*-700*h* may be controlled accordingly. For example, the operation of the overall system including each fracturing pump 710*a*, 710*b*, each blower unit 720*a*, 720*b*, and each lubrication unit 730*a*, 730*b* is illustrated in FIG. 10. For FIG. 10, all states, including off state, can transition directly to the Emergency Stop state. The space heater is on only if the blower is off. The beacon light turns red whenever the pump discharge pressure is greater than a pre-defined setpoint.

The operation of the lubrication unit 730*a*, 730*b* is illustrated in FIG. 11. For FIG. 11, if the cooling fan is enable it will turn on when oil temperature is high and turn off when low automatically. The operation of the blower unit 720*a*, 720*b* is illustrated in FIG. 12 and the state chart is followed when the blower is in Auto mode, which is set by hardware, i.e. the electrical circuit.

Figure 13:
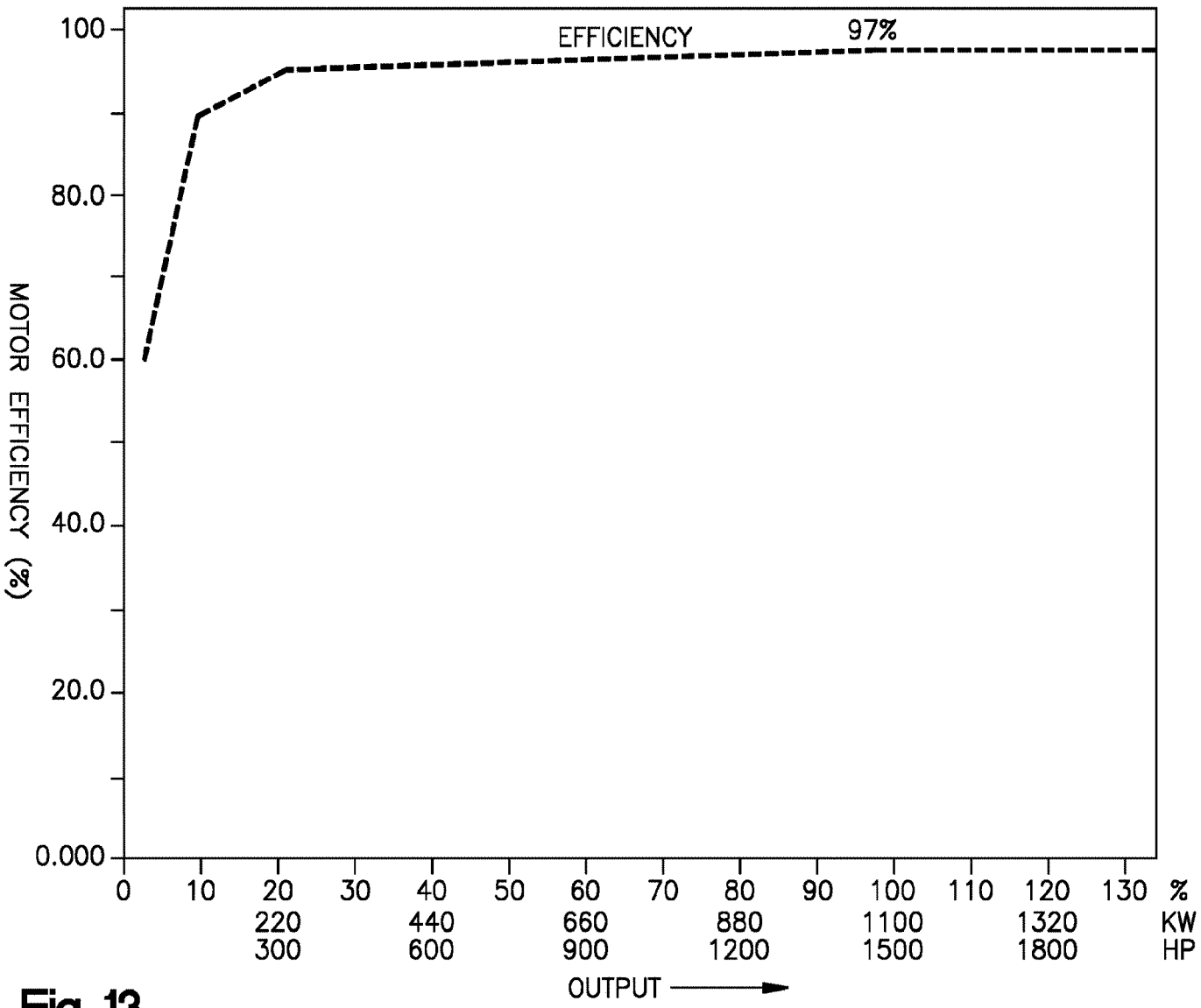
FIG. 13 is a diagram illustrating an example graph of AC motor efficiency as a function of rated Power output.
Figure 14:
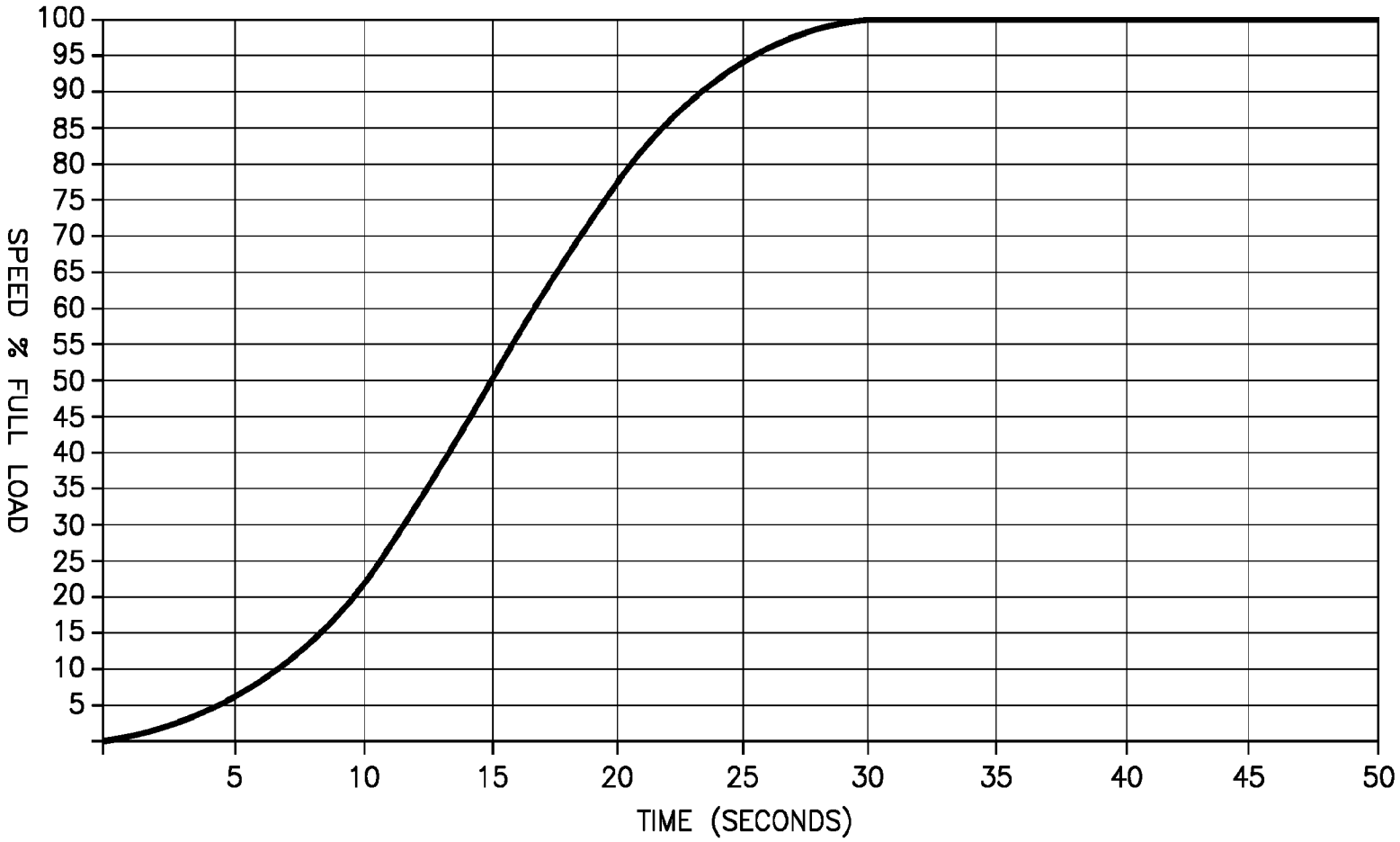
FIG. 14 is a diagram illustrating an example of a starter/breaker performance graph, velocity ramp S curve over a 30 second time period.

Referring to FIGS. 13 and 14, an embodiment includes a method for computational control of the speeds of the AC motors such that hydraulic fracturing design parameters, among these being injection rate and pressures, can be automatically achieved. Using this method, an operator can enter a target injection rate and injection pressure limit, or alternatively, a target injection pressure and injection rate limit, whereby an algorithm automatically adjusts the AC motors' speed set points to collectively reach the target quantity, while not collectively exceeding the limit quantity. For example, not all fracturing motors are used and some fracturing motors are backup motors. In response to an input from an operator or a user that increases the target injection rate, or in response to failure of one or more other fracturing motors, one or more backup fracturing motors can be automatically powered and initiated.

In this embodiment, Darcy's law, generally expressed as:

$$q = \frac{-\kappa}{\mu}\nabla p,$$

where q is discharge rate per unit area, K is intrinsic permeability, μ is viscosity, and ∇p is the pressure gradient vector, is employed as a means to computationally predict the change in injection pressure which will result from a proposed change in speed of any combination of the AC motors. Alternatively, the change in injection rate required to reach a desired injection pressure can be predicted. The Darcy parameters need not be measured directly; an embodiment may estimate the parameters from available surface measurements. This embodiment allows the fracturing motors to produce process outputs, namely injection rates or pressures, that adhere as closely as possible to the fracture design targets without exceeding specified limit parameters, as deemed necessary to preserve the integrity of the formation fracture, the well bore, and the equipment onsite.

For example, the intrinsic permeability and viscosity values may be calculated at time $T_0$ by dividing the measured change in discharge rate from time $T_{-1}$ to $T_0$ by the measured change in pressure from time $T_{-1}$ to $T_0$. Using the calculated ratio of intrinsic permeability and viscosity, the pressure at time $T_1$ may be estimated for a different discharge rate at time $T_1$, thereby predicting the pressure change with a change in the discharge rate.

In a preferred embodiment, VFD process data, not limited to currents and frequency, temperatures, power, percent of rated load, torque and percent of torque, output voltage and motor load, and system status can be collected, communicated by a communications channel to the system control unit to raise an alarm to the user whenever any of the operating parameters exceeds a corresponding threshold value. This allows an operator to intervene such that the VFD workload can be shared equally among the available VFDs at the wellsite, thus minimizing the number of VFD faults and thermal shut down events caused by over driving particular pieces of fracturing equipment.

An embodiment can combine the automatic pumping rate and automatic pumping pressure control of with the VFD load management to automatically distribute VFD power output among the wellsite equipment, producing the same load management benefits but without requiring operator intervention.

Referring specifically to FIG. 13, an embodiment combining the methods and apparatus described above may be designed to automatically select and control an optimal quantity of available AC motors and VFDs, such that each motor selected runs as closely to its maximum operating efficiency as possible. As illustrated in FIG. 13, AC induction motors have an efficiency to power output relationship similar to that shown. Computationally, an optimal number of AC motors can be selected, and such selection can be varied over time, such that each operates as closely to its rated power output, and thus highest efficiency as possible, subject to the fracture design parameters and the number and types of pumping equipment available.

Referring specifically to FIG. 14, the VFD controls the acceleration and deceleration of motors/pumps based on a programmed "S" curve. The "S" curve is established to ensure that the mass and inertia of the motors/pumps is properly managed to avoid damage or nuisance shutdowns of the VFD. FIG. 14 is an example graphical representation of such an "S" curve. The VFD operates in one of the various pre-defined pulse width modulated control techniques such as Constant Torque or Sensor-less Vector, based on enabling the maximum starting capability against higher wellhead pressures.

FIGS. 15A-15E are algorithmic block diagrams illustrating examples of the operation of the system control unit in automatic target rate and/or automatic target pressure modes.

Figure 15A:
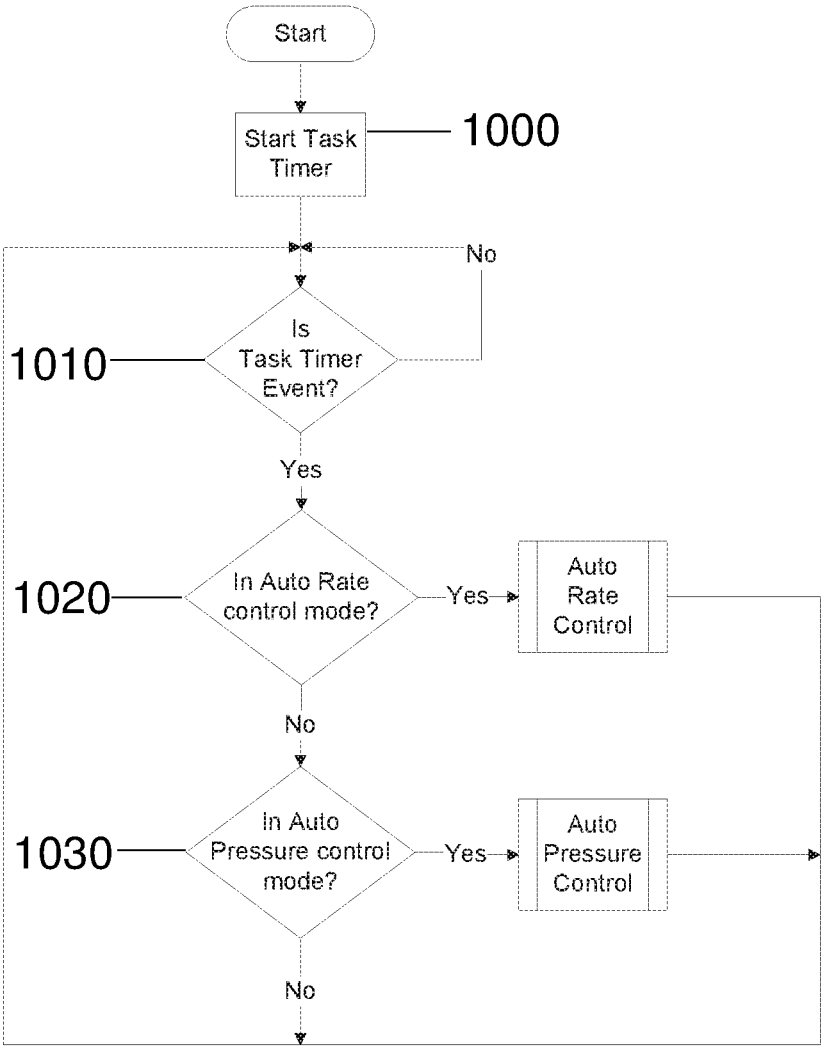
FIGS. 15A, 15B, 15C, 15D, and 15E are algorithmic block diagrams illustrating examples of the operations of the system control unit in automatic target rate and/or automatic target pressure modes.

Referring to FIG. 15A, an operation of detecting whether auto rate control or auto pressure control is selected by an operator begins with a start task timer step 1000, if a task timer event is achieved in step 1010, the operation proceeds to detecting if auto rate control mode is selected in step 1020. If auto rate control mode is selected, the operation proceeds to the auto rate control module described in FIG. 15B. If not selected, the operation proceeds to detecting if auto pressure control mode is selected in step 1030. If auto pressure control mode is selected, the operation proceeds to the auto pressure control module described in FIG. 15C. If neither mode is selected, manual control by the operator is being used and the operation loops back to detecting a task timer event in step 1010.

Figure 15B:
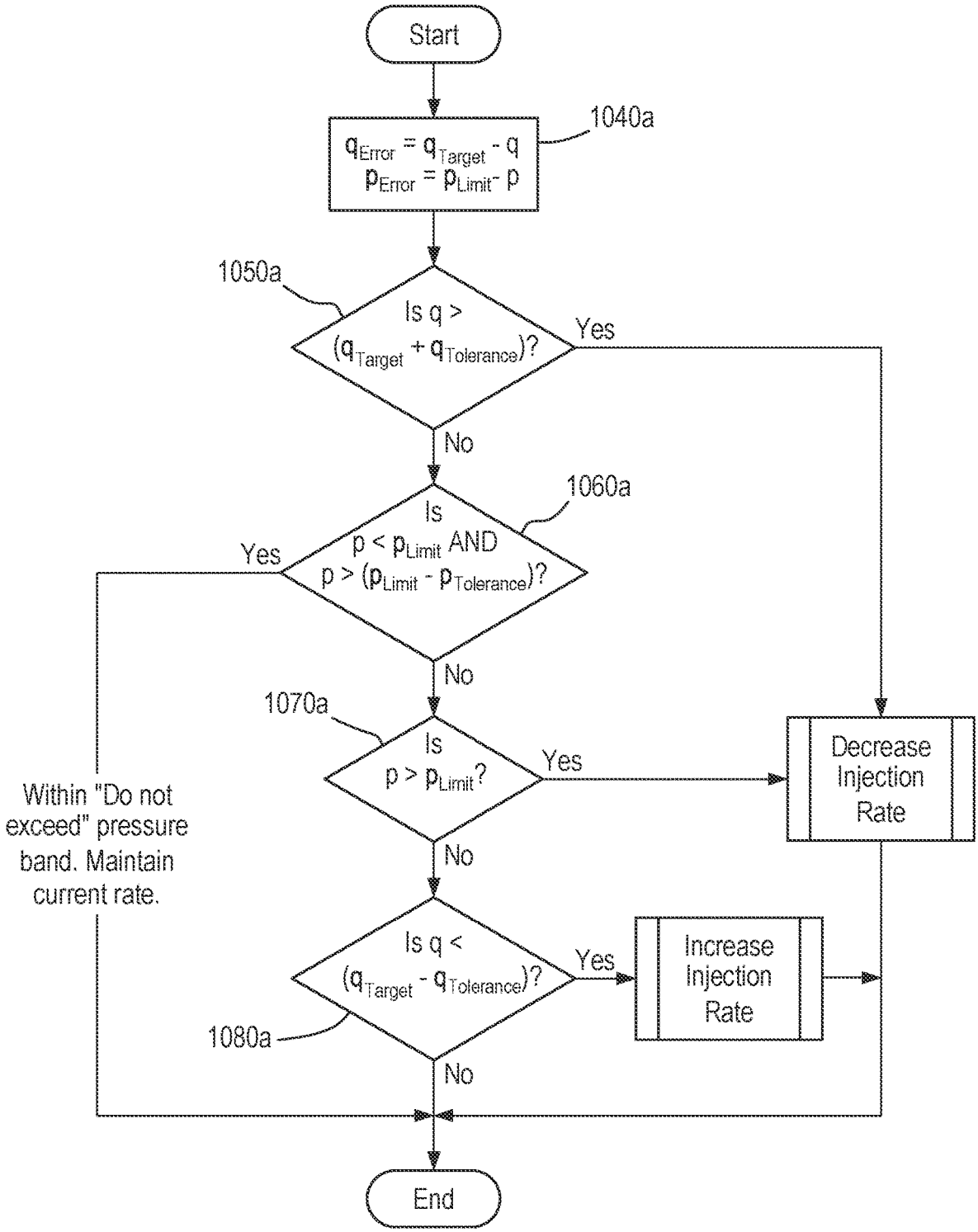
Figure 15C:
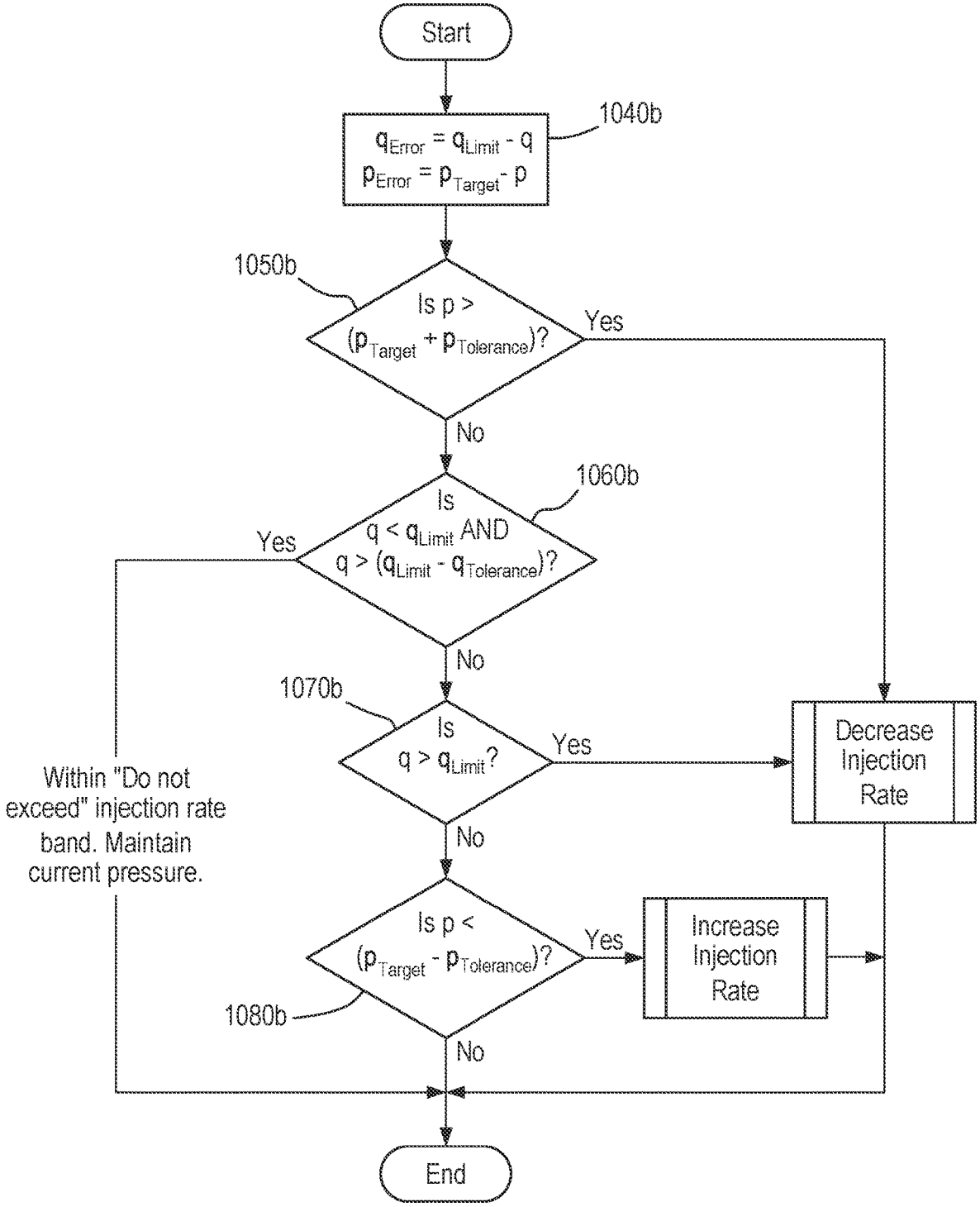

Referring to FIGS. 15B and 15C, if auto rate control or auto pressure control is selected, an operation of determining whether to decrease injection rate, increase injection rate, or maintain the current injection rate based on a target injection rate or a target pressure rate is implemented. In this example, p is the measured injection pressure, $p_{Target}$ is the target injection pressure, $p_{Limit}$ is the injection pressure limit, $p_{Tolerance}$ is the acceptable margin of injection pressure error, $p_{Error}$ is the injection pressure error defined as $p_{Limit}$—p when in auto rate control and defined as $p_{Target}$—p when in auto pressure control.

Similarly, q is the measured injection rate, $q_{Target}$ is the target injection rate, $q_{Limit}$ is the injection rate limit, $q_{Tolerance}$ is the acceptable margin of injection rate error, $q_{Error}$ is the injection rate error defined as $q_{Limit}$-q when in auto pressure control and defined as $q_{Target}$—q when in auto rate control.

Figure 15D:
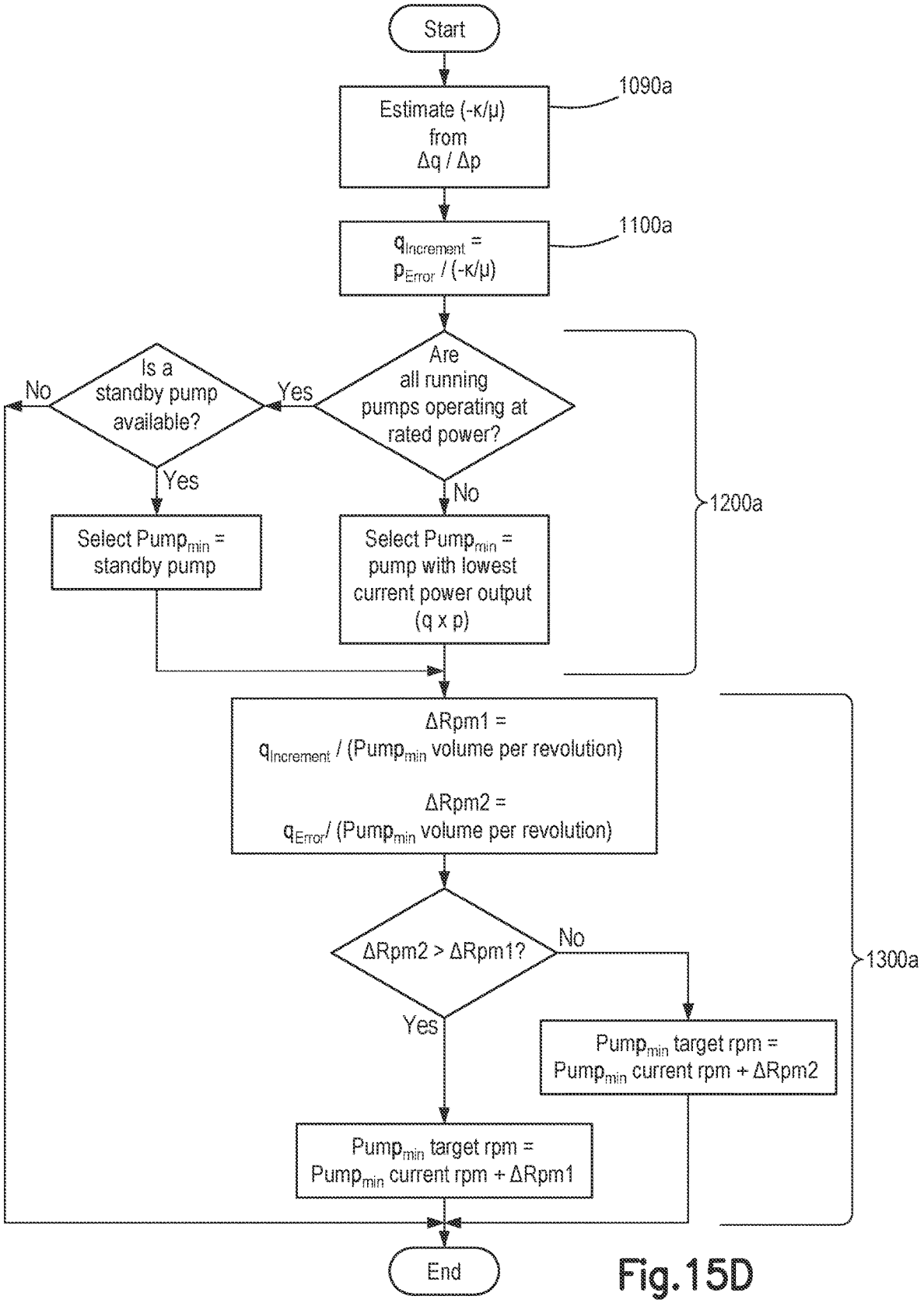
Figure 15E:
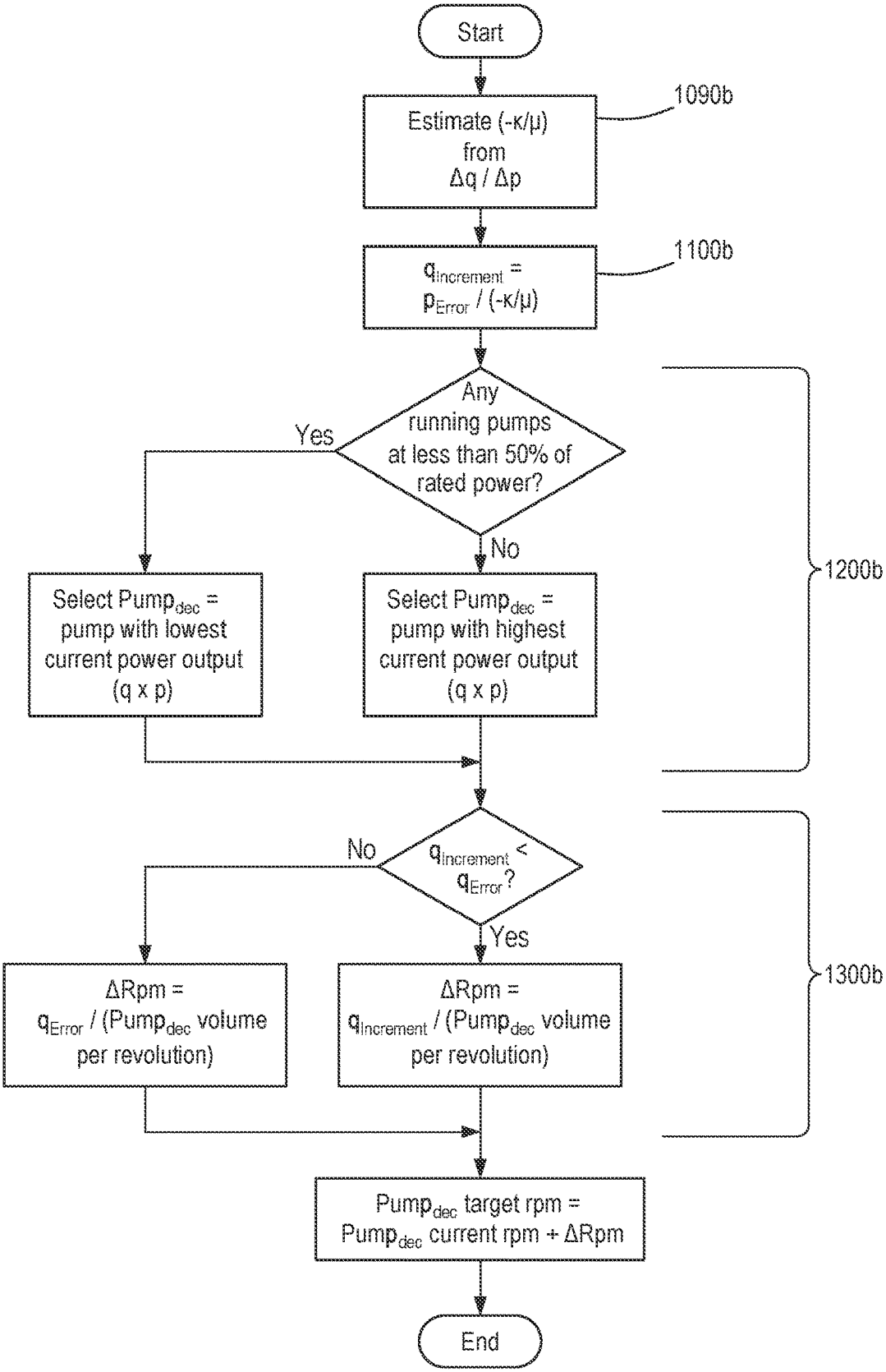

As illustrated in FIGS. 15B and 15C, a first step 1040*a*, 1040*b* of calculating the error values is implemented followed by a next step 1050*a*, 1050*b* of determining whether the measured pressure or measured injection rate exceeds a tolerance value in addition to the target injection rate or a target pressure, depending on whether auto rate or auto pressure is selected, for determining whether injection rate should be decreased following the decrease injection rate module of FIG. 15E. If not, the measured pressure or the measured injection rate is compared to the pressure limit or injection rate limit and the limit minus the tolerance value to determine whether the value falls within a "do not exceed" band in a next step 1060*a*, 1060*b*. If yes, the current injection rate is maintained. If not, the measured pressure or the measured injection rate is compared with the pressure limit or the injection rate limit to determine if the injection rate should be decreased in step 1070*a*, 1070*b*. If the measured value is not greater than the limit value, then the measured pressure or the measured injection rate is compared with the target pressure minus the tolerance value or the target injection rate minus the tolerance value in a next step 1080*a*, 1080*b* to determine whether the injection rate should be increased following the increase injection rate module of FIG. 15D.

Referring to FIGS. 15D and 15E, an increase injection rate module or a decrease injection rate module is illustrated, respectively, for determining which pump to increase the injection rate for and the value of the change in revolutions per minute (RPM) for the selected pump. Referring to both figures, in a first step 1090*a*, 1090*b*, the viscosity and permeability factor is estimated, and then in step(s) 1100*a*, 1100*b* the required change in injection rate, $q_{Increment}$, is calculated as a function of κ, μ, and $p_{Error}$. In the next operations 1200*a*, 1200*b*, the pump for which the injection rate is increased or decreased is selected. In a preferred embodiment, the processing algorithm of the system control unit seeks to maximize the efficiency of the overall system operation. Because electrical motors are most efficient when the operate at or near 100% capacity, the algorithm generally seeks to have all corresponding pumps operate at or near such capacity and brings less-efficiently utilized pumps offline. For the operations 1200*a* used to determine which pump is selected for an increase in injection rate, if any pump is not operating at its rated power, the pump selected is the pump with the lowest current power output. If all pumps are operating at rated power and a standby pump is available, the standby pump is selected for an increase in injection rate. For the operations 1200*b* used to determine which pump is selected for a decrease in injection rate, if any pump is operating at less than 50% of rated power then the pump with the lowest current power output is selected for a decrease in injection rate in order to ultimately use less pumps in the overall system. If no pump is operating at less than 50% then the pump with the highest current power output is selected a decrease in injection rate in order to more evenly distribute the load among the pumps.

Still referring to FIGS. 15D and 15E, the next operations 1300*a*, 1300*b* are used to determine the value of the change of RPMs (ΔRpm), a positive value in FIG. 15D where an increase in injection rate is applied and a negative value in FIG. 15E where a decrease in injection rate is applied. In this example, two values of ΔRpm may be used and the more conservative action for pressure of the well site is selected. In other words, when increasing injection rate, the ΔRpm causing a smaller increase in injection rate is used and when decreasing injection rate the ΔRpm causing a larger decrease in injection rate is used. FIGS. 15D and 15E illustrate two examples of achieving this operation. In FIG. 15D, two ΔRPMs are calculated based on $q_{Increment}$ and $q_{Error}$, and the smaller ΔRPM is selected for increasing the selected pump injection rate. In FIG. 15E, the smaller value (or the larger negative value) between $q_{Increment}$ and $q_{Error}$ is selected to calculate the ΔRpm thereby using the ΔRpm with the largest negative value and applying a greater decrease of injection rate to the selected pump.

As shown in the figures and discussed above, ΔRpm is calculated as a function of either $q_{Increment}$ or $q_{Error}$ and pump characteristics. Specifically, ΔRpm is calculated as a function of pump volume per revolution which is given by $$V_{rev}=n\times\pi r^2 l,$$

where $n$ is the number of pump plungers, $r$ is the radius of the plungers, and $l$ is the plunger stroke.

Different equipment and devices may be used to make and use the above described embodiments of the well fracturing system. In an example, the equipment used in the electrical hydraulic fracturing system may be selected from certain commercially available options. By means of illustration only, for the hydraulic fracturing pump units, the selected VFD may be a Toshiba GX7 Rig Drive 1750 HP, 600 V, 1700 AMP 6-pulse Variable Frequency Drive. In a preferred embodiment, there is one (1) Toshiba GX7 VFD per pump system (i.e. VFD, Motor, Pump, and PAC). The selected AC Motor may be an AmeriMex "Dominator" Horizontal AC Cage induction motor rated output is 1750 HP. In a preferred embodiment, there is one (1) AmeriMex AC Motor per pump system (i.e. VFD, Motor, Pump, and PAC). The selected pumps can be either Gardner Denver GD-2250 Triplex Pumps with maximum input of 2250 HP or Weir/SPM TWS-2250 Triplex pumps with maximum input of 2250 HP. In a preferred embodiment, there is one (1) Pump per pump system (i.e. VFD, Motor, Pump, and PAC). Another configuration includes Quintuplex with maximum input of 2500 HP; and alternate material fluid ends for extended life. The selected programmable automation controller (PAC) may be the STW ESX-3XL 32-bit controller. In a preferred embodiment, there is one (1) STW PAC per pump system.

For the hydraulic fracturing blender unit, the selected VFDs may be a Toshiba GX7 Rig Drive 1750 HP, 600 V, 1700 AMP 6-pulse Variable Frequency Drives. In a preferred example, there is one (1) Toshiba GX7 VFD per Slurry Power Unit System (i.e. VFD and Motor). For the Slurry Power Unit (SPU), the selected AC Motors may be the AmeriMex "Dominator" Horizontal AC Cage induction motors rated output is 1150 HP. In a preferred example, there is one (1) AmeriMex AC Motor per Slurry Power Unit System (i.e. VFD and Motor). For the Hydraulic Power Unit (HPU), the selected AC Motors may be the AmeriMex "Dominator" Horizontal AC Cage induction motors rated output is 600 HP. In a preferred example, there is one (1)

AmeriMex AC Motor per Hydraulic Power Unit System. The selected programmable automation controller (PAC) may be the STW ESX-3XL 32-bit controller. In a preferred example, there is one (1) STW PAC per Slurry Power Unit System (i.e. VFD and Motor) and one (1) STW PAC per Hydraulic Power Unit System.

For the hydration unit, the Hydraulic Power Unit (HPU) selected AC Motors may be the AmeriMex "Dominator" Horizontal AC Cage induction motors rated output is 600 HP. In a preferred example, there is one (1) AmeriMex AC Motor per Hydraulic Power Unit System. The selected programmable automation controller (PAC) may be the STW ESX-3XL 32-bit controller. In a preferred example, there is one (1) STW PAC per Hydraulic Power Unit System.

Manufacturers of the above described equipment may include, but are not limited to, Toshiba, Siemens, ABB, GE, Gardner-Denver, Weir/SPM, CAT, FMC, STW, and National Instruments.

Wireless communication among different units of the system and the system control unit may be performed using one or more wireless internet modules within one or more units. A wireless Internet module may be a module for access to wireless Internet, and forming a wireless LAN/Wi-Fi (WLAN), a Wireless broadband (Wibro), a World Interoperability for Microwave Access (Wimax), a High Speed Downlink Packet Access (HSDPA), and the like.

It should be understood that similar to the other processing flows described herein, the steps and the order of the steps in the flowchart described herein may be altered, modified, removed and/or augmented and still achieve the desired outcome. A multiprocessing or multitasking environment could allow two or more steps to be executed concurrently.

While examples have been used to disclose the invention, including the best mode, and also to enable any person skilled in the art to make and use the invention, the patentable scope of the invention is defined by claims, and may include other examples that occur to those of ordinary skill in the art. Accordingly the examples disclosed herein are to be considered non-limiting.

It is further noted that the systems and methods may be implemented on various types of data processor environments (e.g., on one or more data processors) which execute instructions (e.g., software instructions) to perform operations disclosed herein. Non-limiting examples include implementation on a single general purpose computer or workstation, or on a networked system, or in a client-server configuration, or in an application service provider configuration. For example, the methods and systems described herein may be implemented on many different types of processing devices by program code comprising program instructions that are executable by the device processing subsystem. The software program instructions may include source code, object code, machine code, or any other stored data that is operable to cause a processing system to perform the methods and operations described herein. Other implementations may also be used, however, such as firmware or even appropriately designed hardware configured to carry out the methods and systems described herein. For example, a computer can be programmed with instructions to perform the various steps of the flowcharts or state charts shown in FIGS. 10-12.

The systems' and methods' data (e.g., associations, mappings, data input, data output, intermediate data results, final data results, etc.) may be stored and implemented in one or more different types of computer-implemented data stores, such as different types of storage devices and programming constructs (e.g., RAM, ROM, Flash memory, flat files, databases, programming data structures, programming variables, IF-THEN (or similar type) statement constructs, etc.). It is noted that data structures describe formats for use in organizing and storing data in databases, programs, memory, or other computer-readable media for use by a computer program.

The systems and methods may be provided on many different types of computer-readable storage media including computer storage mechanisms (e.g., non-transitory media, such as CD-ROM, diskette, RAM, flash memory, computer's hard drive, etc.) that contain instructions (e.g., software) for use in execution by a processor to perform the methods' operations and implement the systems described herein.

The computer components, software modules, functions, data stores and data structures described herein may be connected directly or indirectly to each other in order to allow the flow of data needed for their operations. It is also noted that a module or processor includes but is not limited to a unit of code that performs a software operation, and can be implemented for example as a subroutine unit of code, or as a software function unit of code, or as an object (as in an object-oriented paradigm), or as an applet, or in a computer script language, or as another type of computer code. The software components and/or functionality may be located on a single computer or distributed across multiple computers depending upon the situation at hand.

It should be understood that as used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise. Finally, as used in the description herein and throughout the claims that follow, the meanings of "and" and "or" include both the conjunctive and disjunctive and may be used interchangeably unless the context expressly dictates otherwise; the phrase "exclusive or" may be used to indicate situation where only the disjunctive meaning may apply.

What is claimed is:

1. A method for stimulating oil or gas production from a wellbore using an electrically powered fracturing system, the method comprising:

a) establishing a fluid connection between a hydraulic fracturing system and the wellbore, wherein the hydraulic fracturing system comprises at least one hydraulic fracturing pump unit, an electrical fracturing blender unit, and a control unit connected to the least one hydraulic fracturing pump unit and the electrical fracturing blender unit via a data channel, wherein the at least one hydraulic fracturing pump unit includes two or more fluid pumps and wherein each fluid pump is driven by an electric pump motor;

b) using at least one fluid pump to pump a blended fracturing fluid down the wellbore;

c) using the control unit to:

i) initialize and maintain operating parameters of the fluid pumps based on information about the flow rate of each fluid pump;

ii) control the electric pump motors so to drive the fluid pumps, wherein controlling the electric pump motors includes the steps of:

A) receiving a target injection pressure and a target injection rate limit;

B) using an algorithm to adjust the electric pump motors speed set points so as to collectively reach the target injection pressure while not collectively exceeding the injection rate limit using predicted values for κ - intrinsic permeability; u - viscosity, and $\nabla_p$- pressure gradient vector to calculate a discharge rate per unit area, q, and using q to computationally predict at least one of the change in injection pressure which will result from a proposed change in speed of any combination of the electric pump motors and the change in injection rate required to reach a desired injection pressure, and wherein q is calculated using κ, u, and $\nabla_p$ in the following equation:

$$q = \frac{-\kappa}{\mu} \cdot \nabla p;$$

and iii) control at least one electrical blending motor to produce a fracturing fluid from the electrical fracturing blender unit.

2. The method of claim 1 further including using at least one of information about the flow rate of the electrically powered hydraulic blender unit and a measured aggregate injection rate of the pumped fracturing fluid or a measured aggregate pressure to determine operating parameters of the fluid pumps.

3. The method according to claim 1, wherein step c)(ii) further includes the step of:

C) selecting one of the two or more fluid pumps and changing operating parameters of the selected fluid pump by:

(1) if an increase in aggregate injection rate is desired and any pump is not operating at its rated power, selecting the pump with the lowest current power output for an increase in injection rate;

(2) if an increase in aggregate injection rate is desired and all pumps are operating at rated power and a standby pump is available, selecting the standby pump for an increase in injection rate;

(3) if a decrease in aggregate injection rate is desired and any pump is operating at less than 50% of rated power, selecting the pump with the lowest current power output for a decrease in injection rate; and (4) if a decrease in aggregate injection rate is desired and no pump is operating at less than 50%, selecting the pump with the highest current power output for a decrease in injection rate.

4. The method of claim 1, further comprising the step of monitoring operating parameters of individual electrical motors and taking individual motors offline when the operating parameters exceed predetermined thresholds.

5. The method of claim 1, further comprising the step of controlling one or more backup pumps when an individual motor is taken offline or additional injection rate is required.

6. A system control unit for use with a system for stimulating oil or gas production from a wellbore, the system control unit comprising:

(a) a hydraulicfracturing pump unit controllerconfigured to control a hydraulic fracturing pump unit having one or more electric pump motors and one or more fluid pumps, wherein each fluid pump is driven by an electric pump motor, wherein the hydraulic fracturing pump unit controllercontrols the electric pump motors, and wherein controlling of the electric pump motors includes:

A) receiving a target injection pressure and a target injection rate limit;

B) using an algorithm to adjust the electric pump motors speed set points so as to collectively reach the target injection pressure while not collectively exceeding the injection rate limit;

(b) a hydraulic blender unit controller configured to control a hydraulic blender pump unit having one or more hydraulic blenderelectrical motors;

wherein the hydraulic fracturing pump unit controller uses predicted values for ϰ- intrinsic permeability; u - viscosity, and $\nabla_p$- pressure gradient vector to calculate a discharge rate per unit area, q, and using q to computationally predict at least one of the change in injection pressure which will result from a proposed change in speed of any combination of the electric pump motors and the change in injection rate required to reach a desired injection pressure, and wherein q is calculated using ϰ, u, and ∇p in the following equation:

$$q = \frac{-\kappa}{\mu} \cdot \nabla p.$$

7. The system control unit of claim 6, further comprising a human machine interface (HMI) communicating with at least one programmable automation controller (PAC) in the hydraulic fracturing pump unit and the hydraulic blender unit.

8. The system control unit of claim 6 wherein the system control unit is located in the physical vicinity of the hydraulic fracturing pump unit and hydraulic blender unit and communicates bidirectionally over a physical medium, such as a cable or an optical fiber, with at least one PAC on the hydraulic fracturing pump unit and hydraulic blender unit.

9. The system control unit of claim 6 wherein the system control unit is located remotely from the hydraulic fracturing pump unit and hydraulic blender unit and communicating wirelessly with at least one PAC on the hydraulic fracturing pump unit and hydraulic blender unit.

* * * * *